US007913419B2

(12) United States Patent
Tomasi et al.

(10) Patent No.: US 7,913,419 B2
(45) Date of Patent: Mar. 29, 2011

(54) NON-TUMBLE CLOTHES DRYER

(75) Inventors: Donald M. Tomasi, Stevensville, MI (US); Robert W. Meyer, Coloma, MI (US); Matthew D. Rhodes, Stevensville, MI (US); Richard A. Sunshine, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 6 days.

(21) Appl. No.: 11/322,502

(22) Filed: Dec. 30, 2005

(65) Prior Publication Data

US 2007/0151120 A1 Jul. 5, 2007

(51) Int. Cl.
*F26B 9/00* (2006.01)

(52) U.S. Cl. ..... 34/595; 34/90; 34/601; 34/602; 34/603; 34/218; 34/239; 34/242; 38/14; 68/5; 68/17 R; 68/24; 68/148; 68/152; 8/158; 211/85.3; 223/69; 223/70; 223/71

(58) Field of Classification Search ..... 34/595, 34/90, 601, 602, 603, 218, 239, 242; 38/14; 8/158; 223/64, 70, 71; 211/85.3; 68/5, 17 R, 68/24, 148, 152
See application file for complete search history.

(56) References Cited

U.S. PATENT DOCUMENTS 380,949 A 4/1888 Shannon
502,237 A 7/1893 Proctor
707,409 A * 8/1902 Guitar ..... 68/143
1,554,666 A * 9/1925 Taylor ..... 237/48
1,665,118 A * 4/1928 Thompson et al. ..... 68/143
1,675,099 A * 6/1928 Gregg et al. ..... 34/85
1,691,042 A * 11/1928 Bell ..... 34/109
1,752,797 A * 4/1930 Hutchinson, Jr ..... 34/69
1,767,157 A 6/1930 Steele
2,060,065 A * 11/1936 Gill et al. ..... 34/197
2,140,961 A 12/1938 Lendle
2,264,887 A * 12/1941 Otis ..... 34/280
2,334,025 A * 11/1943 O'Neill ..... 34/85
2,359,138 A * 9/1944 Martin ..... 68/18 R
2,369,366 A * 2/1945 O'Neill ..... 34/267

(Continued)

FOREIGN PATENT DOCUMENTS

DE 3213420 10/1983

(Continued)

OTHER PUBLICATIONS

NPL: Thor Appliance Company; Washing Machine—APEX by Thor; Jul. 26, 2005 http://thorappliances.com/apex/index.php, http://thorappliances.com/apex/images/apexzoom2.jpg, http://thorappliances.com/apex/apexAnatomy.php.

*Primary Examiner* — Stephen M. Gravini
(74) *Attorney, Agent, or Firm* — Clifton G. Green; McGarry Bair, P.C.

(57) ABSTRACT

A non-tumble dryer comprises a cabinet and a drawer configured to support an article to be dried and slidably mounted to the cabinet. An air supply system provides air to a drying chamber formed at least partially by one of the cabinet and the drawer for drying the article supported by the drawer. The non-tumble dryer can function as a pedestal whereby the top of the cabinet can be configured to support a laundry appliance in an elevated position. Alternatively, the cabinet can overlie one or more laundry appliances.

36 Claims, 18 Drawing Sheets

U.S. PATENT DOCUMENTS

| | | | | | |
|---|---|---|---|---|---|
| 2,422,825 | A | * | 6/1947 | Davis, Jr. | 34/82 |
| 2,434,886 | A | * | 1/1948 | Pugh | 34/60 |
| 2,449,207 | A | * | 9/1948 | Earle | 34/90 |
| 2,463,218 | A | | 3/1949 | Travis | |
| 2,486,058 | A | * | 10/1949 | Patterson et al. | 34/82 |
| 2,539,613 | A | * | 1/1951 | Earle | 62/258 |
| 2,543,579 | A | * | 2/1951 | Kauffman | 34/610 |
| 2,547,238 | A | * | 4/1951 | Tremblay | 34/603 |
| 2,570,529 | A | * | 10/1951 | Dolan | 68/20 |
| 2,611,192 | A | * | 9/1952 | Huebsch | 34/82 |
| 2,645,863 | A | | 7/1953 | Morrison | |
| 2,664,646 | A | * | 1/1954 | Bourner | 34/82 |
| 2,687,578 | A | * | 8/1954 | Richterkessing | 34/127 |
| 2,707,837 | A | * | 5/1955 | Paulsen et al. | 34/607 |
| 2,708,350 | A | * | 5/1955 | Earle | 62/277 |
| 2,716,820 | A | * | 9/1955 | Bourner | 34/82 |
| 2,722,057 | A | * | 11/1955 | Pugh | 34/74 |
| 2,727,315 | A | * | 12/1955 | Candor | 34/543 |
| 2,728,481 | A | * | 12/1955 | Robinson et al. | 220/4.02 |
| 2,742,708 | A | * | 4/1956 | McCormick | 34/76 |
| 2,742,710 | A | * | 4/1956 | Richterkessing | 34/127 |
| 2,750,779 | A | * | 6/1956 | Whyte | 68/19 |
| 2,752,004 | A | * | 6/1956 | Hullar | 55/418 |
| 2,758,387 | A | * | 8/1956 | Chester | 34/562 |
| 2,779,305 | A | * | 1/1957 | Dunkelman | 116/112 |
| 2,795,055 | A | * | 6/1957 | Huebsch | 34/82 |
| 2,799,948 | A | | 7/1957 | Morrison | |
| 2,813,353 | A | * | 11/1957 | McMillan | 34/79 |
| 2,817,157 | A | * | 12/1957 | McCormick | 34/82 |
| 2,817,501 | A | | 12/1957 | Schubert | |
| 2,843,945 | A | * | 7/1958 | Whyte | 34/82 |
| 2,861,355 | A | * | 11/1958 | Douglas | 34/82 |
| 2,867,430 | A | * | 1/1959 | Hullar | 432/107 |
| 2,903,799 | A | * | 9/1959 | Sachaczenski | 34/527 |
| 2,904,895 | A | * | 9/1959 | Bochan | 34/527 |
| 2,985,967 | A | * | 5/1961 | Pataillot et al. | 34/608 |
| 3,000,108 | A | * | 9/1961 | Jones et al. | 34/607 |
| 3,001,295 | A | * | 9/1961 | Miller | 34/82 |
| 3,023,514 | A | * | 3/1962 | Gibson | 34/589 |
| 3,061,942 | A | * | 11/1962 | Scofield | 34/82 |
| 3,064,358 | A | * | 11/1962 | Giuffre | 34/569 |
| 3,068,588 | A | * | 12/1962 | Richterkessing | 34/549 |
| 3,120,329 | A | * | 2/1964 | Noakes | 222/373 |
| 3,197,886 | A | * | 8/1965 | Brame et al. | 34/90 |
| 3,256,616 | A | * | 6/1966 | McGoldrick | 34/104 |
| 3,316,659 | A | * | 5/1967 | Lauck | 34/600 |
| 3,344,532 | A | * | 10/1967 | Bigler | 34/600 |
| 3,402,477 | A | | 9/1968 | Hubbard | |
| 3,417,481 | A | * | 12/1968 | Rumsey, Jr. | 34/72 |
| 3,432,939 | A | | 3/1969 | Eichholz | |
| 3,555,701 | A | * | 1/1971 | Hubbard | 34/602 |
| 3,579,851 | A | * | 5/1971 | Elmy | 34/82 |
| 3,670,425 | A | | 6/1972 | Benjamin et al. | |
| 3,724,095 | A | * | 4/1973 | Laue et al. | 34/139 |
| 3,739,496 | A | | 6/1973 | Buckley et al. | |
| 3,744,402 | A | * | 7/1973 | Piegza et al. | 99/360 |
| 3,789,514 | A | * | 2/1974 | Faust | 34/82 |
| 3,793,744 | A | | 2/1974 | Saita | |
| 3,811,198 | A | | 5/1974 | Baltes | |
| 3,840,998 | A | * | 10/1974 | Marcussen | 34/128 |
| 3,866,336 | A | | 2/1975 | Bereza | |
| 4,109,397 | A | * | 8/1978 | Daily | 34/239 |
| 4,180,919 | A | | 1/1980 | Baltes | |
| 4,471,537 | A | * | 9/1984 | Meda | 34/77 |
| 4,513,545 | A | * | 4/1985 | Hopkins, Jr. | 52/79.1 |
| 4,557,058 | A | * | 12/1985 | Ozawa et al. | 34/82 |
| 4,617,743 | A | * | 10/1986 | Barnard | 34/109 |
| 4,625,432 | A | | 12/1986 | Baltes | |
| 4,642,909 | A | * | 2/1987 | Garcia | 34/97 |
| 4,653,200 | A | * | 3/1987 | Werner | 34/82 |
| 4,682,424 | A | | 7/1987 | Irving | |
| 4,819,341 | A | | 4/1989 | Gayso | |
| 4,908,957 | A | | 3/1990 | Acosta, Sr. et al. | |
| 5,014,446 | A | * | 5/1991 | Reesman | 34/620 |
| 5,042,170 | A | * | 8/1991 | Hauch et al. | 34/82 |
| 5,062,219 | A | * | 11/1991 | Harris et al. | 34/606 |
| 5,067,253 | A | * | 11/1991 | Hauch et al. | 34/82 |
| 5,136,792 | A | * | 8/1992 | Janecke | 34/78 |
| 5,152,077 | A | | 10/1992 | Liang | |
| 5,165,181 | A | * | 11/1992 | Acosta et al. | 34/90 |
| 5,210,960 | A | * | 5/1993 | LaRue | 34/82 |
| 5,236,478 | A | * | 8/1993 | Lewis et al. | 55/319 |
| 5,249,374 | A | * | 10/1993 | Henningsen et al. | 34/213 |
| 5,279,047 | A | * | 1/1994 | Janecke | 34/78 |
| 5,305,484 | A | | 4/1994 | Fitzpatrick et al. | |
| 5,369,892 | A | | 12/1994 | Dhaemers | |
| 5,388,344 | A | * | 2/1995 | Wallach | 34/91 |
| 5,435,837 | A | * | 7/1995 | Lewis et al. | 96/54 |
| 5,463,820 | A | * | 11/1995 | La Rue | 34/235 |
| 5,524,362 | A | * | 6/1996 | Quandt et al. | 34/526 |
| 5,546,678 | A | | 8/1996 | Dhaemers | |
| 5,555,640 | A | | 9/1996 | Ou | |
| 5,560,120 | A | * | 10/1996 | Swanson et al. | 34/82 |
| 5,568,691 | A | | 10/1996 | Rubin | |
| 5,588,313 | A | * | 12/1996 | Hildebrand | 68/17 R |
| 5,606,878 | A | * | 3/1997 | Arreghini et al. | 68/17 R |
| 5,664,339 | A | * | 9/1997 | Swanson et al. | 34/82 |
| 5,666,743 | A | | 9/1997 | Dawson | |
| 5,675,908 | A | * | 10/1997 | Barnes | 34/235 |
| 5,743,025 | A | * | 4/1998 | Jordan, Jr. | 34/600 |
| 5,755,040 | A | | 5/1998 | Ou | |
| 5,806,207 | A | * | 9/1998 | Merrigan | 34/603 |
| 5,815,944 | A | * | 10/1998 | Palmer | 34/202 |
| 5,815,961 | A | | 10/1998 | Estes et al. | |
| 5,957,557 | A | | 9/1999 | Langer et al. | |
| 6,016,610 | A | * | 1/2000 | Sears | 34/82 |
| 6,035,545 | A | * | 3/2000 | Jones | 34/202 |
| 6,101,741 | A | * | 8/2000 | Sears | 34/417 |
| 6,134,806 | A | | 10/2000 | Dhaemers | |
| 6,151,795 | A | * | 11/2000 | Hoffman et al. | 34/92 |
| 6,174,577 | B1 | * | 1/2001 | Vitorino | 428/36.5 |
| 6,189,346 | B1 | | 2/2001 | Chen et al. | |
| 6,263,591 | B1 | | 7/2001 | La Porte | |
| 6,363,756 | B1 | * | 4/2002 | Seagar et al. | 68/210 |
| 6,374,644 | B1 | * | 4/2002 | Rhode et al. | 68/20 |
| 6,425,192 | B2 | * | 7/2002 | Arrieta et al. | 34/486 |
| D474,566 | S | | 5/2003 | Baldwin et al. | |
| 6,584,702 | B2 | * | 7/2003 | Irey | 34/417 |
| 6,585,225 | B1 | | 7/2003 | Lake | |
| 6,732,552 | B2 | | 5/2004 | Kim et al. | |
| 6,732,553 | B2 | * | 5/2004 | Rhode et al. | 68/20 |
| 6,745,496 | B2 | | 6/2004 | Cassella | |
| 6,796,055 | B2 | | 9/2004 | Baltes | |
| 6,845,569 | B1 | | 1/2005 | Kim | |
| 6,860,032 | B2 | | 3/2005 | Meyer | |
| 6,865,911 | B2 | * | 3/2005 | Bolduan et al. | 68/17 R |
| 6,868,621 | B1 | | 3/2005 | Grimm et al. | |
| 6,889,449 | B2 | | 5/2005 | Silver | |
| D506,090 | S | | 6/2005 | Ben-Or | |
| 6,910,292 | B2 | | 6/2005 | Prows | |
| 6,922,911 | B2 | * | 8/2005 | Lam | 34/239 |
| 6,955,067 | B2 | * | 10/2005 | Davenet et al. | 68/17 R |
| 6,973,740 | B2 | * | 12/2005 | Meyer | 34/224 |
| 7,036,243 | B2 | * | 5/2006 | Doh et al. | 34/595 |
| 7,055,262 | B2 | * | 6/2006 | Goldberg et al. | 34/86 |
| 7,065,904 | B2 | * | 6/2006 | Lee et al. | 34/601 |
| 7,171,761 | B1 | * | 2/2007 | Hunts | 34/91 |
| 7,191,546 | B2 | * | 3/2007 | Maruca | 34/201 |
| 7,207,197 | B2 | * | 4/2007 | North | 68/5 C |
| 7,251,905 | B2 | * | 8/2007 | Doh et al. | 34/603 |
| 7,296,236 | B2 | * | 11/2007 | King | 715/746 |
| 7,296,443 | B2 | * | 11/2007 | Usherovich et al. | 68/3 R |
| 7,412,853 | B2 | * | 8/2008 | Hong et al. | 68/19.1 |
| 7,497,030 | B2 | * | 3/2009 | Belgard | 34/82 |
| 7,520,145 | B2 | * | 4/2009 | Hong et al. | 68/12.27 |
| 7,562,543 | B2 | * | 7/2009 | Kendall et al. | 68/13 R |
| 7,587,917 | B2 | * | 9/2009 | Gilboe et al. | 68/240 |
| 7,591,082 | B2 | * | 9/2009 | Lee et al. | 34/600 |
| 7,617,702 | B2 | * | 11/2009 | Sunshine et al. | 68/3 R |
| 7,624,600 | B2 | * | 12/2009 | Sunshine et al. | 68/3 R |
| 7,624,601 | B2 | * | 12/2009 | Ikemizu et al. | 68/17 R |
| 7,628,043 | B2 | * | 12/2009 | Sunshine et al. | 68/38 |
| 7,644,515 | B2 | * | 1/2010 | Doh | 34/603 |
| 7,665,225 | B2 | * | 2/2010 | Goldberg et al. | 34/73 |
| 7,665,227 | B2 | * | 2/2010 | Wright et al. | 34/339 |
| 7,673,358 | B2 | * | 3/2010 | Dietz et al. | 8/158 |
| 2001/0000834 | A1 | * | 5/2001 | Irey | 34/235 |

2001/0020338 A1* 9/2001 Arrieta et al. ..... 34/202
2002/0017117 A1 2/2002 Sunshine et al.
2002/0092329 A1* 7/2002 Rhode et al. ..... 68/24
2003/0079368 A1* 5/2003 Hoffman ..... 34/202
2003/0182732 A1* 10/2003 Davenet et al. ..... 8/158
2003/0221333 A1* 12/2003 Lam ..... 34/220
2004/0093913 A1* 5/2004 Bolduan et al. ..... 68/17 R
2004/0134087 A1* 7/2004 Meyer ..... 34/90
2004/0134088 A1* 7/2004 Meyer ..... 34/90
2004/0134237 A1* 7/2004 Sunshine et al. ..... 68/3 R
2004/0163184 A1* 8/2004 Waldron et al. ..... 8/149.1
2004/0194339 A1 10/2004 Johnson et al.
2004/0221624 A1 11/2004 Fumagalli
2004/0226320 A1 11/2004 Bongini
2004/0245899 A1 12/2004 Cho
2004/0263032 A1 12/2004 Cho
2005/0035076 A1 2/2005 Schober et al.
2005/0040184 A1 2/2005 Noyes et al.
2005/0056059 A1* 3/2005 Usherovich et al. ..... 68/12.02
2005/0066538 A1* 3/2005 Goldberg et al. ..... 34/218
2005/0092032 A1* 5/2005 North ..... 68/3 R
2005/0092033 A1* 5/2005 Luckman et al. ..... 68/124
2005/0120585 A1* 6/2005 Lee et al. ..... 34/602
2005/0120757 A1 6/2005 Jackson
2005/0126035 A1* 6/2005 Lee et al. ..... 34/602
2005/0132593 A1* 6/2005 Doh et al. ..... 34/73
2005/0132594 A1* 6/2005 Doh et al. ..... 34/73
2005/0132604 A1* 6/2005 Hong et al. ..... 34/603
2005/0155393 A1 7/2005 Wright et al.
2005/0275325 A1* 12/2005 Yang ..... 312/330.1
2006/0042114 A1* 3/2006 Robson et al. ..... 34/90
2006/0075790 A1* 4/2006 Jeon et al. ..... 68/17 R
2006/0096335 A1* 5/2006 Park et al. ..... 68/20
2006/0101589 A1* 5/2006 Hong et al. ..... 8/158
2006/0112737 A1* 6/2006 Sunshine et al. ..... 68/3 R
2006/0117810 A1* 6/2006 Kendall et al. ..... 68/3 R
2006/0123853 A1* 6/2006 Hong et al. ..... 68/19
2006/0123854 A1* 6/2006 Hong et al. ..... 68/19.1
2006/0130243 A1* 6/2006 Ozaltin et al. ..... 8/158
2006/0130535 A1* 6/2006 Sunshine et al. ..... 68/3 R
2006/0156765 A1* 7/2006 Sunshine et al. ..... 68/13 R
2006/0179676 A1* 8/2006 Goldberg et al. ..... 34/77
2006/0207121 A1* 9/2006 Lee ..... 34/89
2007/0028479 A1* 2/2007 Hunts ..... 34/202
2007/0068034 A1* 3/2007 Kim ..... 34/499
2007/0113419 A1* 5/2007 Belgard ..... 34/82
2007/0144031 A1* 6/2007 Lee ..... 34/446
2007/0151120 A1* 7/2007 Tomasi et al. ..... 34/601
2007/0151300 A1* 7/2007 Sunshine ..... 68/3 R
2007/0151301 A1* 7/2007 Kendall et al. ..... 68/3 R
2007/0151302 A1* 7/2007 Kendall et al. ..... 68/3 R
2007/0151303 A1* 7/2007 Doyle et al. ..... 68/13 R
2007/0151304 A1* 7/2007 Kendall et al. ..... 68/13 R
2007/0151305 A1* 7/2007 Kendall et al. ..... 68/13 R
2007/0151306 A1* 7/2007 Gilboe et al. ..... 68/13 R
2007/0151307 A1* 7/2007 Gilboe et al. ..... 68/13 R
2007/0151309 A1* 7/2007 Kendall et al. ..... 68/235 R
2007/0151310 A1* 7/2007 Wright et al. ..... 68/3 R
2007/0151311 A1* 7/2007 McAllister et al. ..... 68/3 R
2007/0151312 A1* 7/2007 Bruce et al. ..... 68/3 R
2007/0163097 A1* 7/2007 Metcalfe et al. ..... 28/100
2007/0256457 A1* 11/2007 Kendall et al. ..... 68/3 R
2007/0266740 A9* 11/2007 Kendall et al. ..... 68/3 R
2007/0266743 A9* 11/2007 Sunshine et al. ..... 68/13 R
2007/0283723 A9* 12/2007 Sunshine et al. ..... 68/3 R
2007/0283724 A9* 12/2007 Sunshine ..... 68/3 R
2008/0000098 A1* 1/2008 Choi et al. ..... 34/114
2008/0052950 A1* 3/2008 Park et al. ..... 34/524
2008/0053162 A1* 3/2008 Park et al. ..... 68/13 R
2008/0053163 A1* 3/2008 Park et al. ..... 68/13 R
2008/0053164 A1* 3/2008 Park et al. ..... 68/13 R
2008/0053166 A1* 3/2008 Lim ..... 68/5 C
2008/0110214 A1* 5/2008 Snider et al. ..... 68/237
2008/0120865 A1* 5/2008 Smith ..... 34/239
2008/0141550 A1* 6/2008 Bae et al. ..... 34/68
2008/0141552 A1* 6/2008 Bae et al. ..... 34/108
2008/0141554 A1* 6/2008 Bae et al. ..... 34/132
2008/0141557 A1* 6/2008 Son et al. ..... 34/565
2008/0141558 A1* 6/2008 Bae et al. ..... 34/595
2008/0141734 A1* 6/2008 Son et al. ..... 68/5 C
2008/0148494 A1* 6/2008 Son et al. ..... 34/68
2008/0155757 A1* 7/2008 Kim et al. ..... 8/149.3
2008/0155758 A1* 7/2008 Hong et al. ..... 8/149.3
2008/0163651 A1* 7/2008 Jeong et al. ..... 68/5 C
2008/0165506 A1* 7/2008 McCoy et al. ..... 361/727
2008/0168678 A1* 7/2008 Menlove ..... 34/235
2008/0168679 A1* 7/2008 Son et al. ..... 34/497
2008/0178634 A1* 7/2008 Kim et al. ..... 68/23.2
2008/0189166 A1* 8/2008 Brooks ..... 705/10
2008/0229515 A1* 9/2008 Hong et al. ..... 68/149.3
2008/0256989 A1* 10/2008 Jeong et al. ..... 68/5 C
2008/0271263 A1* 11/2008 Bae et al. ..... 8/159
2008/0271336 A1* 11/2008 Doh ..... 34/82
2008/0271500 A1* 11/2008 Ahn ..... 68/5 C
2008/0276659 A1* 11/2008 Bae et al. ..... 68/5 C
2008/0276660 A1* 11/2008 Bae et al. ..... 68/5 C
2008/0276661 A1* 11/2008 Bae et al. ..... 68/5 C
2008/0282745 A1* 11/2008 Han et al. ..... 68/20
2009/0090018 A1* 4/2009 Stein ..... 34/60
2009/0113745 A1* 5/2009 Choi et al. ..... 34/139
2009/0113755 A1* 5/2009 Choi et al. ..... 34/390
2009/0126222 A1* 5/2009 Bae et al. ..... 34/527
2009/0126414 A1* 5/2009 Kim et al. ..... 68/6
2009/0126421 A1* 5/2009 Kim et al. ..... 68/5 C
2009/0126422 A1* 5/2009 Kim et al. ..... 68/5 C
2009/0126423 A1* 5/2009 Bae et al. ..... 68/5 C
2009/0133281 A1* 5/2009 Yoon et al. ..... 34/72
2009/0133284 A1* 5/2009 Belgard ..... 34/480
2009/0139037 A1* 6/2009 Jeong et al. ..... 8/149.3
2009/0145176 A1* 6/2009 Kim et al. ..... 68/27
2009/0145177 A1* 6/2009 Kim et al. ..... 68/13 R
2009/0151205 A1* 6/2009 Kim et al. ..... 38/2
2009/0158616 A1* 6/2009 Ricklefs et al. ..... 34/601
2009/0172967 A1* 7/2009 Son et al. ..... 34/318
2009/0193856 A1* 8/2009 Park et al. ..... 68/5 C
2009/0228156 A1* 9/2009 Hong et al. ..... 700/300
2009/0235551 A1* 9/2009 Jo et al. ..... 34/427
2009/0235697 A1* 9/2009 Reid et al. ..... 68/3 SS
2009/0241269 A1* 10/2009 Yoo et al. ..... 8/149.3
2009/0241606 A1* 10/2009 Yoo et al. ..... 68/5 C
2009/0249839 A1* 10/2009 Moon et al. ..... 68/5 C
2009/0255300 A1* 10/2009 Doyle et al. ..... 68/13 R
2009/0255301 A1* 10/2009 Sunshine ..... 68/13 R
2009/0260246 A1* 10/2009 Bae et al. ..... 34/60
2009/0260403 A1* 10/2009 Kendall et al. ..... 68/4
2009/0260405 A1* 10/2009 Kendall et al. ..... 68/27
2009/0260406 A1* 10/2009 Bae et al. ..... 68/5 C
2009/0265953 A1* 10/2009 Bae et al. ..... 34/467
2009/0266114 A1* 10/2009 Kendall et al. ..... 68/27
2009/0266116 A1* 10/2009 Kendall et al. ..... 68/13 R
2009/0266117 A1* 10/2009 Kendall et al. ..... 68/13 R
2009/0266118 A1* 10/2009 Kendall et al. ..... 68/13 R
2009/0277035 A1* 11/2009 Choi et al. ..... 34/130
2009/0277036 A1* 11/2009 Lee et al. ..... 34/215
2009/0277037 A1* 11/2009 Lim ..... 34/215
2009/0288456 A1* 11/2009 Bae et al. ..... 68/5 R
2009/0293552 A1* 12/2009 Gilboe et al. ..... 68/13 R
2009/0293553 A1* 12/2009 Kendall et al. ..... 68/13 R
2009/0320313 A1* 12/2009 Bae et al. ..... 34/132
2009/0320317 A1* 12/2009 Bae et al. ..... 34/282
2010/0000112 A1* 1/2010 Carow et al. ..... 34/357
2010/0000114 A1* 1/2010 Dalton et al. ..... 34/389
2010/0000117 A1* 1/2010 Choi et al. ..... 34/443
2010/0005681 A1* 1/2010 Jo et al. ..... 34/215
2010/0011609 A1* 1/2010 Park et al. ..... 34/88
2010/0018262 A1* 1/2010 Beihoff et al. ..... 68/5 C
2010/0024243 A1* 2/2010 Ricklefs et al. ..... 34/474
2010/0058815 A1* 3/2010 Lim et al. ..... 68/15
2010/0077801 A1* 4/2010 Son et al. ..... 68/20
2010/0083521 A1* 4/2010 Han et al. ..... 34/130
2010/0083708 A1* 4/2010 Han et al. ..... 68/15
2010/0083709 A1* 4/2010 Han et al. ..... 68/13 R
2010/0083710 A1* 4/2010 Han et al. ..... 68/13 R
2010/0083711 A1* 4/2010 Han et al. ..... 68/13 R

FOREIGN PATENT DOCUMENTS

DE 3417481 A1 * 11/1985
DE 3708516 A1 * 9/1988

| | | | |
|---|---|---|---|
| DE | 3710615 | A1 * | 10/1988 |
| DE | 4228469 | | 5/1993 |
| DE | 9419048 | | 3/1995 |
| DE | 19716825 | | 4/1998 |
| DE | 19832675 | | 1/2000 |
| DE | 19838630 | | 3/2000 |
| DE | 19922647 | | 11/2000 |
| DE | 20101254 | | 4/2001 |
| DE | 10055918 | | 5/2002 |
| DE | 20302572 | | 4/2003 |
| EP | 0050395 | | 4/1982 |
| EP | 355701 | A2 * | 2/1990 |
| EP | 1146161 | A1 | 4/2000 |
| EP | 1205129 | | 5/2002 |
| EP | 1277182 | | 7/2002 |
| EP | 1288367 | | 3/2003 |
| EP | 1431442 | | 6/2004 |
| EP | 1467015 | | 10/2004 |
| FR | 1116286 | | 5/1956 |
| GB | 336679 | | 10/1930 |
| GB | 617965 | | 2/1949 |
| GB | 2407860 | | 5/2005 |
| JP | 64009000 | | 1/1989 |
| JP | 02307414 | | 12/1990 |
| JP | 04187194 | | 7/1992 |
| JP | 04220210 | | 8/1992 |
| JP | 04220211 | | 8/1992 |
| JP | 04220212 | | 8/1992 |
| JP | 04220213 | | 8/1992 |
| JP | 04220214 | | 8/1992 |
| JP | 04237000 | | 8/1992 |
| JP | 07116395 | | 5/1995 |
| JP | 07227495 | | 8/1995 |
| JP | 08047599 | | 2/1996 |
| JP | 09010492 | | 1/1997 |
| JP | 10057699 | | 3/1998 |
| JP | 2000218095 | | 8/2000 |
| JP | 2000225299 | | 8/2000 |
| JP | 2001157800 | | 6/2001 |
| JP | 2002000997 | | 1/2002 |
| JP | 2002126395 | | 5/2002 |
| JP | 2002136799 | | 5/2002 |
| JP | 2002233693 | | 8/2002 |
| JP | 2003114611 | | 4/2003 |
| KR | 200201898 | | 11/2000 |
| KR | 1020040009401 | | 1/2004 |
| WO | 9629458 | | 9/1996 |
| WO | 9829595 | | 7/1998 |
| WO | 2004099308 | | 11/2004 |
| WO | 2005001191 | | 1/2005 |
| WO | 2005045121 | | 5/2005 |

* cited by examiner

NON-TUMBLE CLOTHES DRYER

BACKGROUND OF THE INVENTION

1. Field of the Invention

The invention relates to a non-tumble clothes dryer.

2. Description of the Related Art

Conventionally, the process of doing laundry involves washing the laundry in a washing machine followed by drying the laundry in a tumble clothes dryer. However, some clothing items, such as those designated as delicates, are not made to withstand the tumbling that occurs in the clothes dryer, and some loads of laundry are relatively small, having only a few clothing items, to warrant drying the load in the clothes dryer. Rather than drying these clothing items in the tumble clothes dryer, they can be laid flat to air dry, such as on a drying rack, or dried in a non-tumble clothes dryer. Non-tumble clothes dryers dry the clothing items while they are stationary (i.e., laid flat or hung) rather than while tumbling.

Known household non-tumble clothes dryers are integrated with the tumble clothes dryer or configured to be a pedestal with its own cabinet that supports the tumble clothes dryer in an elevated position above the ground. The known pedestal non-tumble clothes dryer relies on the air supply and heating system of the tumble clothes dryer for operation. As a result, the pedestal non-tumble clothes dryer cannot be utilized as a stand-alone appliance separate from the tumble clothes dryer and cannot be moved to another location, such as above the tumble clothes dryer or above or below the washing machine. Additionally, the width of the pedestal non-tumble clothes dryer is limited to the width of the laundry appliance, but many clothing items are larger than this width when laid flat.

SUMMARY OF THE INVENTION

A drying pedestal according to one embodiment of the invention for supporting a laundry appliance in an elevated position comprises a cabinet having a top configured to support a laundry appliance and defining an open face providing access to an interior of the cabinet, a drawer configured to support an article to be dried and movably mounted to the cabinet for movement relative to the interior through the open face, a non-tumble drying chamber formed at least partially by one of the cabinet and the drawer, and an air supply system mounted in the cabinet to provide air to the non-tumble drying chamber for drying the article supported by the drawer.

The drawer can comprise a drying rack for supporting the article to be dried in a generally horizontal position. The drying rack can comprise an air-permeable panel that at least partially supports the article to be dried and permits air from the air supply system to flow through the drying rack.

The cabinet can form the non-tumble drying chamber, and the drying rack can be movable with the drawer relative to the non-tumble drying chamber. The drying chamber can have an air inlet and an air outlet, where one of the air inlet and the air outlet is located above the drying rack, and the other of the air inlet and the air outlet is located below the drying rack. The drying pedestal can further comprise an air duct fluidly coupling the air outlet to the air inlet. The air duct can extend laterally behind the drawer. The drying pedestal can further comprise a heating system fluidly coupled to the air duct to heat the air passing through the air duct.

The air supply system can direct air beneath the drawer when the drawer is received in the interior of the cabinet. The drawer can comprise a bottom wall having a plurality of apertures, and the air blown beneath the drawer can enter the drawer through the apertures. The drawer can further comprise a peripheral wall extending upward from the bottom wall to define the non-tumble drying chamber. The drying pedestal can further comprise a heating system mounted in the cabinet to heat the air supplied by the air supply system. The heating system can comprise a heating element mounted in the cabinet below the drawer to heat to the air as it flows beneath the drawer before entering the drawer through the apertures.

The air supply system can comprise a blower having an outlet that directs the air through the non-tumble drying chamber and an inlet that receives the air exhausted from the non-tumble drying chamber.

The top of the cabinet can have a width approximately equal to that of the laundry appliance.

A drying pedestal according to another embodiment of the invention for supporting a laundry appliance in an elevated position comprises a cabinet having a top configured to support a laundry appliance and defining a drying chamber and an open face providing access to the drying chamber, a drawer configured to support an article to be dried and movably mounted to the cabinet for movement relative to the drying chamber through the open face, and an air supply system mounted in the cabinet to provide air to the drying chamber for drying the article supported by the drawer.

The drawer can comprise at least one drying rack for supporting the article to be dried in a generally horizontal position. The at least one drying rack can comprise an air-permeable panel that at least partially supports the article to be dried and permits air from the air supply system to flow through the at least one drying rack. The drawer can further comprise a drawer front mounted to the at least one drying rack to form the drawer. The drawer can comprise at least two of the drying racks vertically spaced from one another, and an uppermost drying rack of the at least two drying racks can be movably mounted to the drawer.

The drying chamber can have an air inlet and an air outlet, where one of the air inlet and the air outlet is located above the at least one drying rack, and the other of the air inlet and the air outlet is located below the at least one drying rack. The drying pedestal can further comprise an air duct fluidly coupling the air outlet to the air inlet. The air duct can extend laterally behind the drawer. The drying pedestal can further comprise a heating system fluidly coupled to the air duct to heat the air passing through the air duct.

The air supply system can comprise a blower having an outlet that directs the air through the non-tumble drying chamber and an inlet that receives the air exhausted from the non-tumble drying chamber.

A non-tumble clothes dryer according to an other embodiment of the invention for use with a pair of laundry appliances in a side-by-side arrangement comprises a cabinet having a width sized to overlie the pair of laundry appliances and defining an interior and an open face providing access to the interior of the cabinet, a drawer configured to support an article to be dried and movably mounted to the cabinet for movement relative to the interior through the open face, a non-tumble drying chamber formed at least partially by one of the cabinet and the drawer, and an air supply system to provide air to the non-tumble drying chamber for drying the article supported by the drawer.

The cabinet width can be sized to completely overlie the pair of laundry appliances. The cabinet width can be greater than a width required to completely overlie the pair of laundry appliances. The cabinet can have a top configured to support the pair of laundry appliances in an elevated position.

The cabinet can form the non-tumble drying chamber.

The drawer can comprise at least one drying rack for supporting the article to be dried in a generally horizontal position. The at least one drying rack can comprise an air-permeable panel that at least partially supports the article to be dried and permits air from the air supply system to flow through the at least one drying rack. The drawer can comprise at least two of the drying racks vertically spaced from one another, and an uppermost drying rack of the at least two drying racks can be movably mounted to the drawer.

The drying chamber can have an air inlet and an air outlet, where one of the air inlet and the air outlet is located above the at least one drying rack, and the other of the air inlet and the air outlet is located below the at least one drying rack. The drying pedestal can further comprise an air duct fluidly coupling the air outlet to the air inlet. The air duct can extend laterally behind the drawer.

The non-tumble clothes dryer can further comprise a heating system fluidly coupled to the air supply system for heating the air in the air supply system. The heating system can be mounted in the cabinet.

The air supply system can be mounted in the cabinet.

The air supply system can comprise a blower having an outlet that directs the air through the non-tumble drying chamber and an inlet that receives the air exhausted from the non-tumble drying chamber.

DESCRIPTION OF EMBODIMENTS OF THE INVENTION

Figure 1:
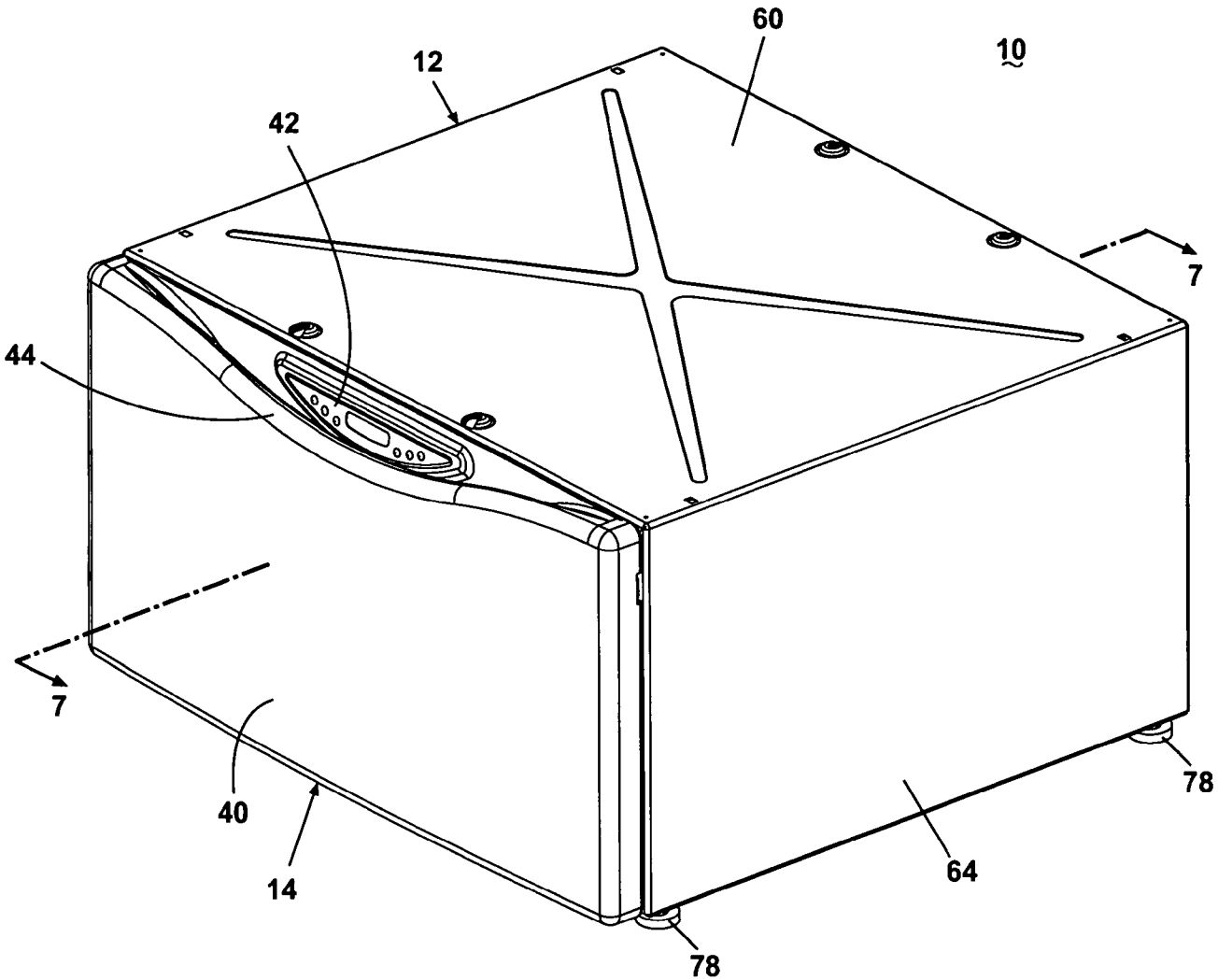
FIG. 1 is a perspective view of a non-tumble dryer according to one embodiment of the invention comprising a drawer slidably mounted to a cabinet and shown in a closed position.
Figure 2:
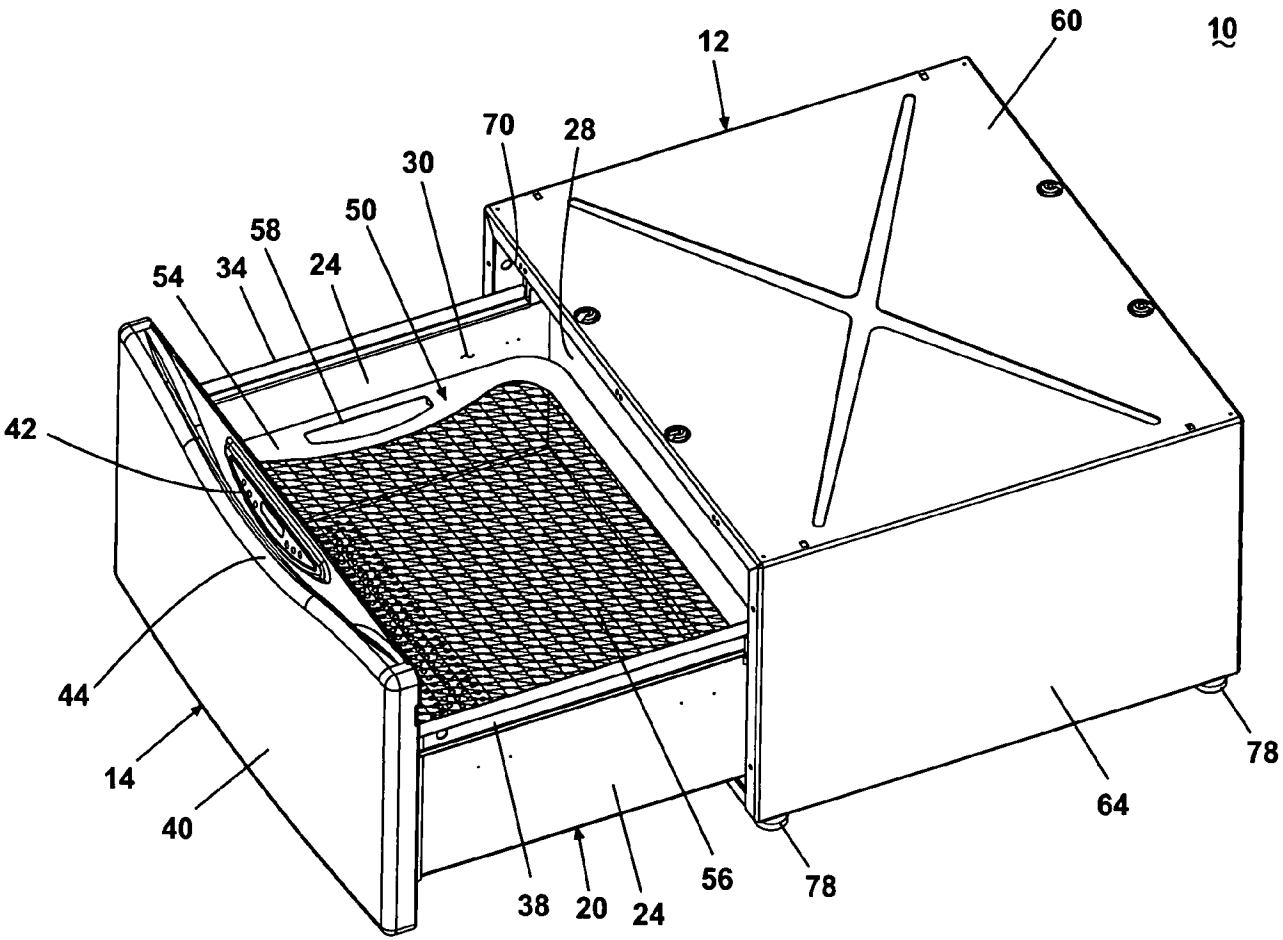
FIG. 2 is a perspective view of the non-tumble dryer of FIG. 1 with the drawer shown in an opened position.

Referring now to the figures, FIGS. 1-9 illustrate a non-tumble dryer 10 according to one embodiment of the invention comprising a cabinet 12 and a drawer 14 slidably mounted to the cabinet 12 between a closed position, as shown in FIG. 1, and an opened position, as shown in FIG. 2. When the drawer 14 is in the opened position, a user can load fabric items, such as clothes, shoes, hats, linens, and the like, into the drawer 14 so that when the drawer 14 is moved to the closed position, the fabric items can be dried in the non-tumble dryer 10.

Figure 3:
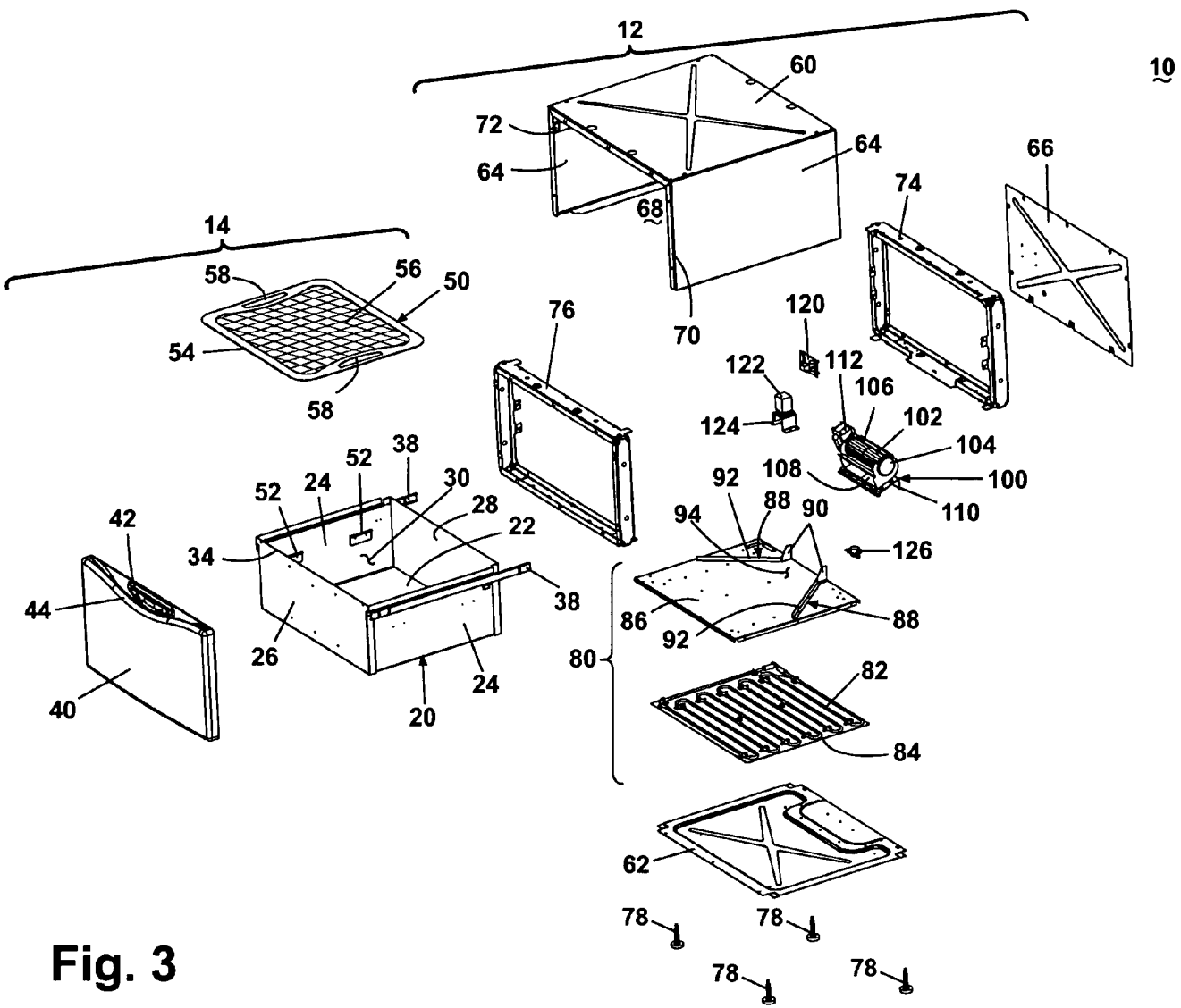
FIG. 3 is an exploded view of the non-tumble dryer of FIG. 1.
Figure 4:
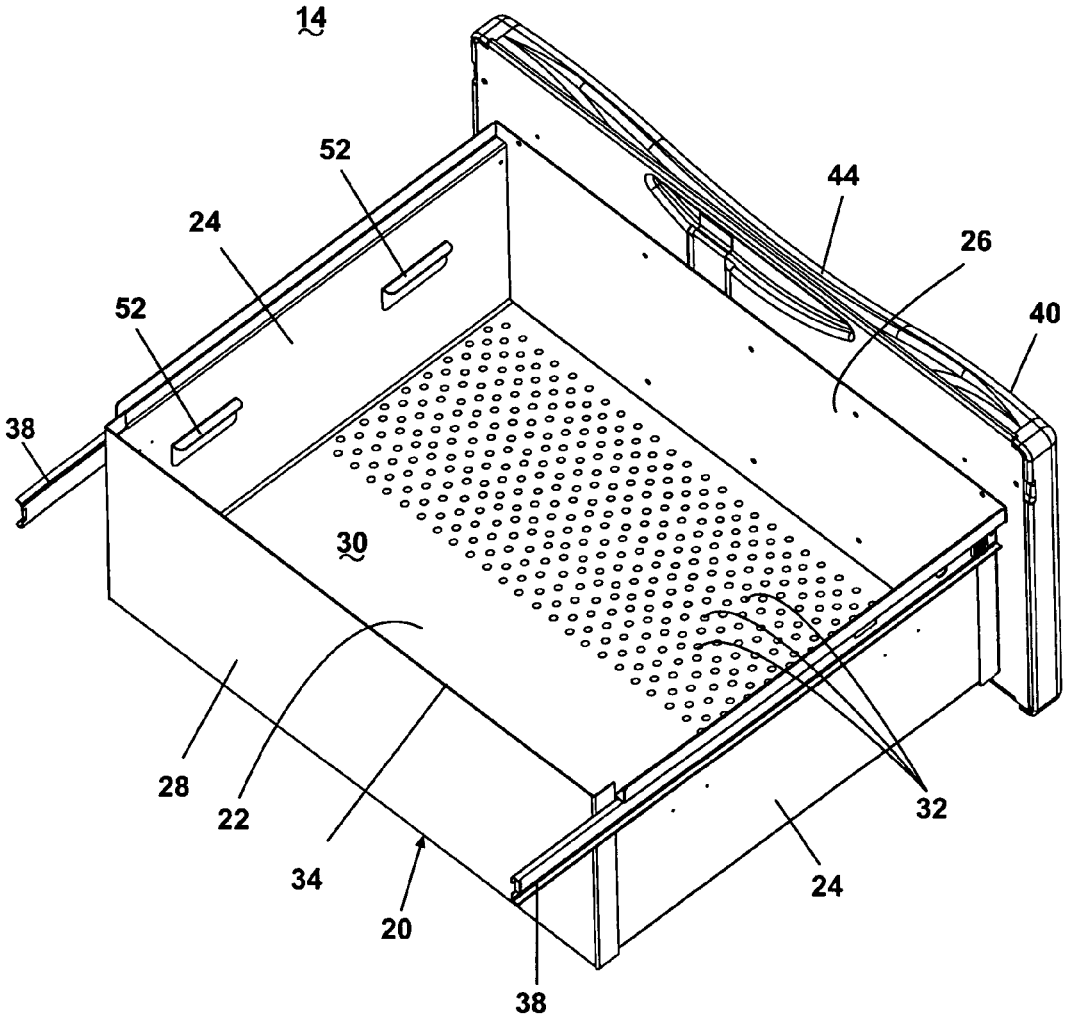
FIG. 4 is a rear perspective view of the drawer from the non-tumble dryer of FIG. 1.
Figure 5:
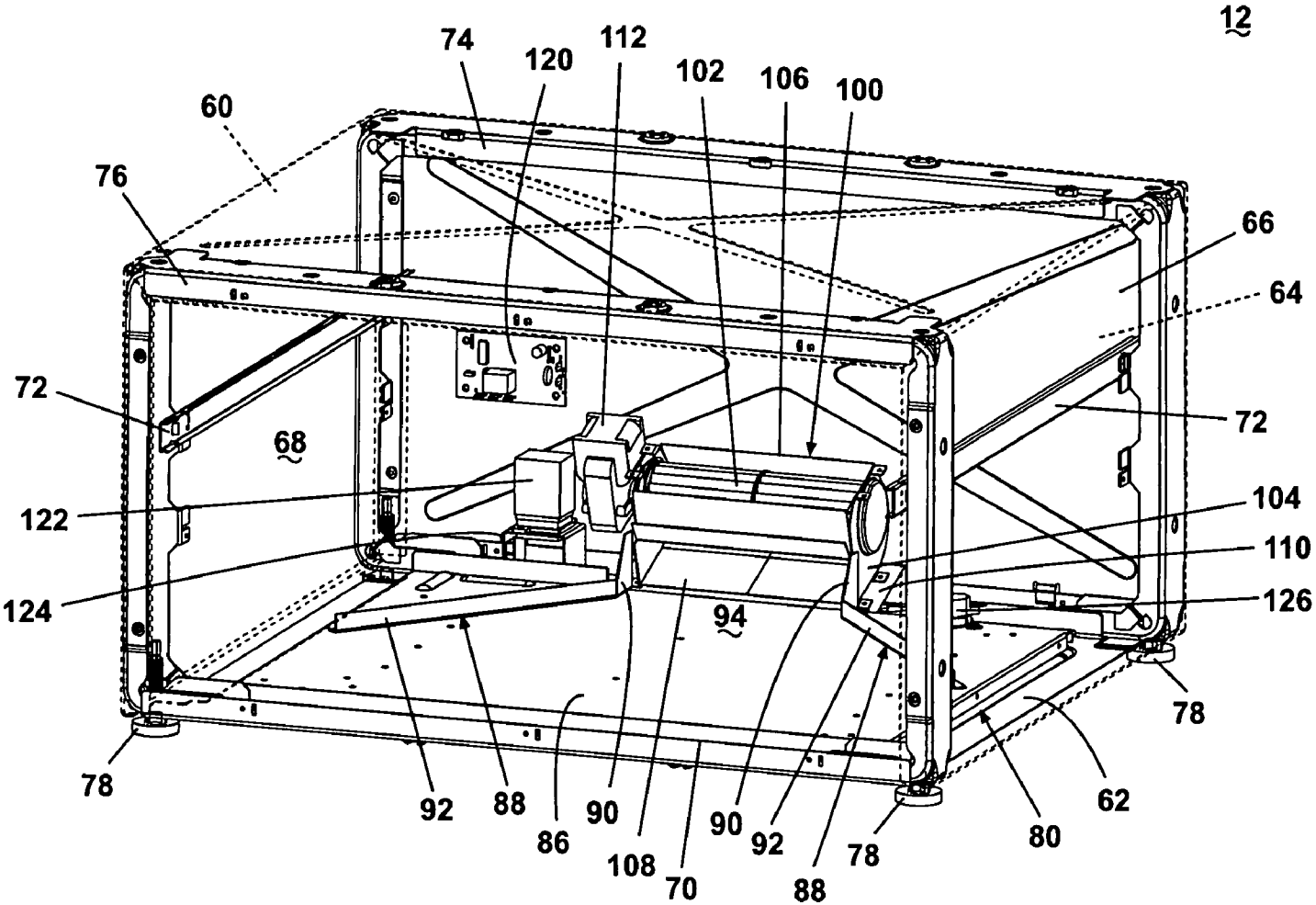
FIG. 5 is a perspective view of the non-tumble dryer without the drawer and with the cabinet shown in phantom.

Referring now to FIG. 3, the drawer 14 comprises an open-top housing 20 formed by a bottom wall 22 and a peripheral wall having a pair of side walls 24 joined by a front wall 26 and a rear wall 28. The housing 20 forms an open-top drying chamber 30 having an inlet defined by a plurality of inlet apertures 32 formed in the bottom wall 22. As best viewed in FIG. 4, the inlet apertures 32 in the illustrated embodiment are generally circular and are arranged in a plurality of horizontal rows extending from near the front wall 26 to about midway between the front wall 26 and the rear wall 28. The inlet apertures 32, however, can have any suitable shape, size, and arrangement and can comprise a single aperture or a plurality of apertures that collectively have a desired cross-sectional area for airflow into the drying chamber 30. The drying chamber 30 has an outlet 34 defined by the open top of the housing 20. In the illustrated embodiment, the open top of the housing 20 is collectively formed by the upper edges of the peripheral wall 24, 26, 28. The drawer 14 further comprises a conventional slide 38 mounted on an exterior surface of each of the side walls 24 for slidably mounting the drawer 14 to the cabinet 12.

Referring back to FIG. 3, a drawer front 40 mounted to the front wall 26 of the housing 20 provides an aesthetic appearance to the drawer 14 and supports a control panel 42 for selecting a desired drying cycle and otherwise controlling the operation of the non-tumble dryer 10. The drawer front 40 includes a handle 46 formed below the control panel 42. The user can grasp the handle 46 when moving the drawer 14 between the closed and opened positions. The control panel 42 and the handle 44 shown in the figures are provided for exemplary purposed only; it is within the scope of the invention to utilize other types of control panels and handles and to locate the control panel and handle elsewhere on the non-tumble dryer 10.

The drawer 14 further comprises at least one drying rack 50 supported by horizontally aligned rack supports 52 mounted to or integrally formed with interior surfaces of the drawer housing side walls 24. The drying rack 50 comprises a frame 54 that surrounds a panel 56 upon which the clothing items can rest. The panel 56 is air-permeable so that air can flow from the inlet apertures 32 and through the panel 56 to the outlet 34 of the drying chamber 30. For example, the panel 56 can be made of a mesh material or can be a rigid framework that forms a plurality of holes. The frame 54 includes a pair of grips 58 that a user can grasp for mounting the drying rack 50 on the rack supports 52 or removing the drying rack 50 from the rack supports 52 and the drying chamber 30. The drawer 50 can comprise any desired number of the drying racks 50 and has a corresponding number of sets of rack supports 52. Optionally, the location of the rack supports 52 on the side walls 24 or the front and rear walls 26, 28 can be adjustable so as to adjust the vertical position of the drying rack 50 in the drying chamber 30. Alternatively, the drawer 14 can comprise several sets of the rack supports 52 fixed to the side walls 24 to provide several vertical positions for the drying rack 50.

The cabinet 12 comprises spaced top and bottom walls 60, 62 joined by a pair of spaced side walls 64 that are integrally formed with the top wall 60. The top, bottom, and side walls 60, 62, 64 are joined along their rear edges by a rear wall 66 to define an interior 68 of the cabinet 12 accessible through an opening 70 formed by the front edges of the top, bottom, and side walls 60, 62, 64. A track 72 is mounted to an interior surface of each of the side walls 64. The tracks 72 mate with the slides 38 on the drawer 14 in a conventional fashion to slidably mount the drawer 14 to the cabinet 12. The interior 68 of the cabinet 12 is sized to receive the drying chamber 30 when the drawer 14 is slid into the closed position through the opening 70. The cabinet 12 is structurally reinforced by a generally rectangular rear cabinet frame 74 near the rear wall 66 and a generally rectangular front cabinet frame 76 adjacent the opening 70. The cabinet walls 60, 62, 64, 66 and the rear and front cabinet frames 74, 76 are secured together with mechanical fasteners. However, it is to be understood that the cabinet walls 60, 62, 64, 66 and the rear and front cabinet frames 74, 76 can be secured together in any suitable manner and with any suitable joining processes. The cabinet 12 can be supported by a plurality of feet 78 mounted to the bottom of the cabinet 12.

With continued reference to FIG. 3, the cabinet bottom wall 62 supports a heating system 80 comprising a heating element 82 mounted to a heating element support panel 84 and positioned below a heat transfer plate 86. The heating element 82 can be any suitable source of heat, such as a gas or electric heating element, and is shown in the illustrated embodiment as a serpentine electric heating element that extends across substantially the entire surface area of the heating element support panel 84, which has a surface area slightly smaller than that of the cabinet bottom wall 62. The heat transfer plate 86, which is made of a heat conductive material and has a size comparable to that of the heating element support panel 84, is positioned above and in close proximity to the heating element 82 so that heat generated by the heating element 82 conducts through the heat transfer plate 86. The heating system 80 further comprises a pair of air guides 88 mounted to an upper surface of the heat transfer plate 86. Each of the air guides 88 has a relatively tall rear portion 90 mounted near a rear edge of the heat transfer plate 86 and an elongated front portion 92 extending diagonally forward and outward from the rear portion 90 before terminating near a side edge of the heat transfer plate 86. Thus, the air guides 88 form a generally V-shaped air duct or channel 94 that extends from the rear edge of the heat transfer plate 86 to about midway between the rear and front edges of the heat transfer plate 86, as best viewed in FIG. 5.

Referring again to FIG. 3, the cabinet 12 houses an air supply system 100 comprising a blower 102 disposed within a housing 104 defining an air inlet 106 and an air outlet 108 for the blower 102. The air inlet 106 extends across an upper portion of the housing 104 to expose a portion of the blower 102, and the air outlet 108 is a generally rectangular opening extending along a front portion of the housing 104. The blower 102 and the housing 104 are supported by a blower bracket 110 mounted to the rear cabinet frame 74 and to the heat transfer plate 86 such that the air outlet 108 is positioned between the rear portions 90 of the air guides 88, as best viewed in FIG. 5. The blower 102 is powered by a blower motor 112 mounted to the housing 104.

The heating element 82 of the heating system 80 and the blower motor 112 of the air supply system 100 are operatively coupled to a relay 122, which is operably coupled to a controller 120. The controller 120 in the illustrated embodiment is mounted to the rear wall 66 of the cabinet 12, and the relay 122 is supported by a relay bracket 124 mounted to the rear cabinet frame 74. The controller 120 is operably coupled to the control panel 42 and controls operation of the heating element 82 and the blower motor 112. The cabinet 12 further houses a power supply 126 for providing power from an external power source to the various components of the non-tumble dryer 10, such as the heating element 82, the blower motor 112, and the controller 120.

Figure 6:
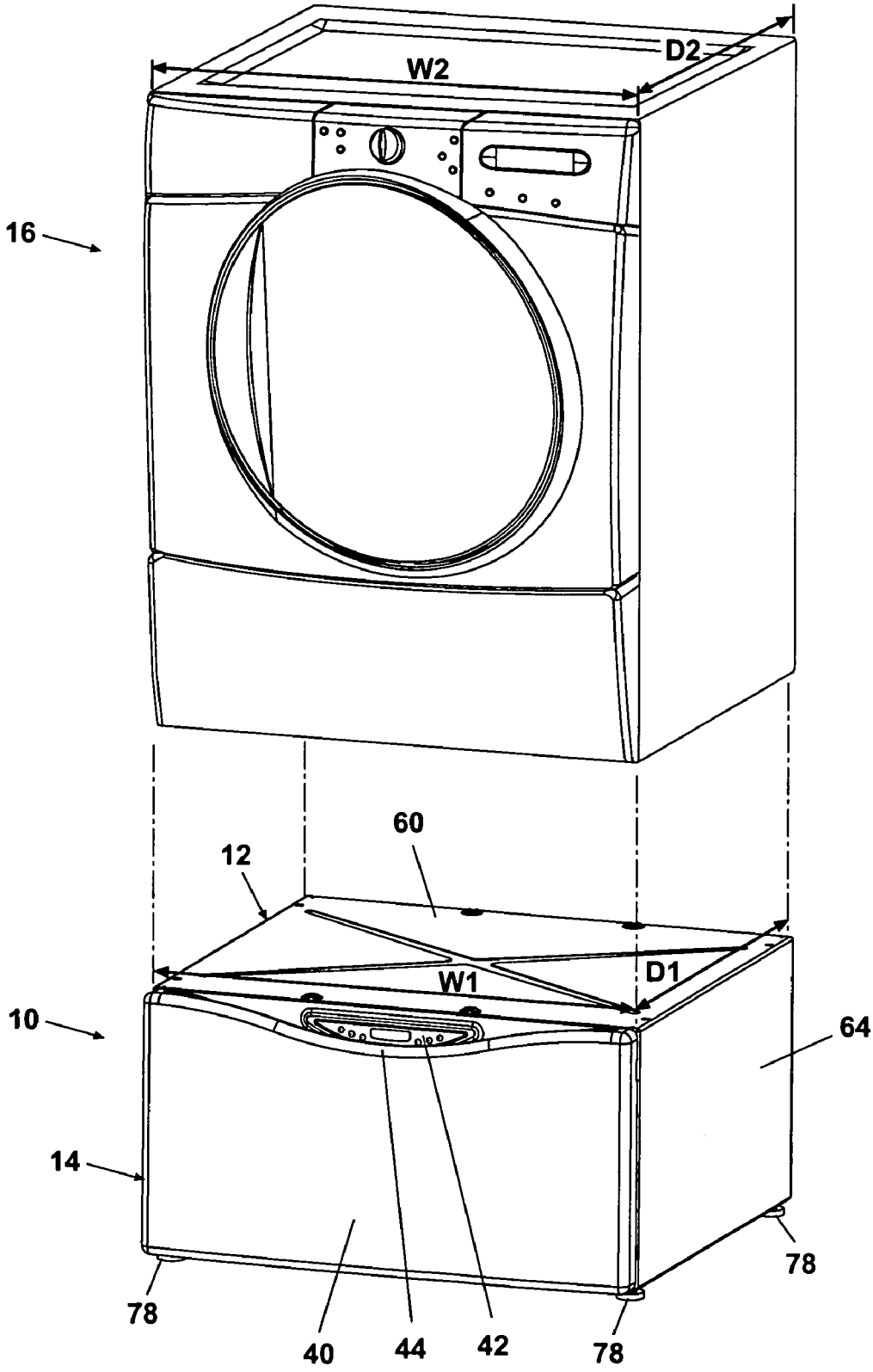
FIG. 6 is an exploded view of the non-tumble dryer of FIG. 1 utilized as a pedestal for a laundry appliance.

The cabinet 12 can be configured as a pedestal to support a laundry appliance 16 in an elevated position, as illustrated in FIG. 6. For example, the cabinet top wall 60 can include supports or brackets designed to mate with the bottom of the laundry appliance 16 and/or can form a recess sized to receive the bottom of the laundry appliance 16. According to the illustrated embodiment, the cabinet top wall 60 is configured to support the laundry appliance 16 in the elevated position as a result of being sized according to the laundry appliance 16. As shown in FIG. 6, the top wall 60 has a width W1 that is approximately equal to a width W2 of the laundry appliance 16 and a depth D1 that is about equal to or greater than a depth D2 of the laundry appliance 16. As a result of this geometry, the laundry appliance 16 can stably rest upon the non-tumble dryer 10. However, because the non-tumble dryer 10 is a stand-alone unit that does not rely upon the laundry appliance 16 for a source of air and/or heat, the non-tumble dryer 10 can be positioned in a location other than below the laundry appliance 16. For example, the non-tumble dryer 10 can be set upon the laundry appliance 16, positioned adjacent to the laundry appliance 16, located in another position relative to the laundry appliance 16, or used in any location without the laundry appliance 16.

An exemplary description of the assembly of the non-tumble dryer 10 follows. The following description is provided for illustrative purposes only and is not intended to limit the invention in any manner. The assembly process can proceed in any suitable chronology and is not limited to the sequence explained below.

To assemble the non-tumble dryer 10, the drawer 14 is assembled separately from the cabinet 12. The drawer 14 is assembled by mounting the front and rear walls 26, 28 to the bottom wall 22 and the side walls 24 to form the drawer housing 20. The drawer front 40 with the control panel 42 is mounted to the front wall 26 of the drawer housing 20, and the slides 38 are attached to the side walls 24. The rack supports 52 are mounted to the drawer housing 20 so that the drying rack 50 can be removably mounted in the drying chamber 30.

The cabinet 12 is assembled by mounting the tracks 72 to the cabinet side walls 64 and mounting the rear and front cabinet frames 74, 76 to the cabinet top wall 60 and side walls 64. The heating system 80 is mounted to the cabinet bottom wall 62, and the bottom wall 62 is attached to the assembly of the cabinet top and side walls 60, 64 and the rear and front cabinet frames 74, 76. The blower bracket 110 is coupled to the rear cabinet frame 74 and the heat transfer plate 86, and the blower housing 104 with the blower 102 and the blower motor 112 mounted thereto is connected to the blower bracket 110. The relay 122 and the relay bracket 124 are mounted to the rear cabinet frame 74, and the power supply 126 is positioned within the cabinet 12. The cabinet rear wall 66 with the controller 120 attached thereto is mounted to the rear end of the cabinet 12, and the feet 78 are mounted to the bottom of the cabinet 12.

After the drawer 14 and the cabinet 12 are individually assembled, the slides 38 on the drawer 14 are coupled with the tracks 72 on the cabinet 12 to slidably mount the drawer 14 to the cabinet 12.

An exemplary description of the operation of the non-tumble dryer 10 follows. The following description is provided for illustrative purposes only and is not intended to limit the invention in any manner. The operation process can proceed in any suitable chronology and is not limited to the sequence explained below.

Figure 7:
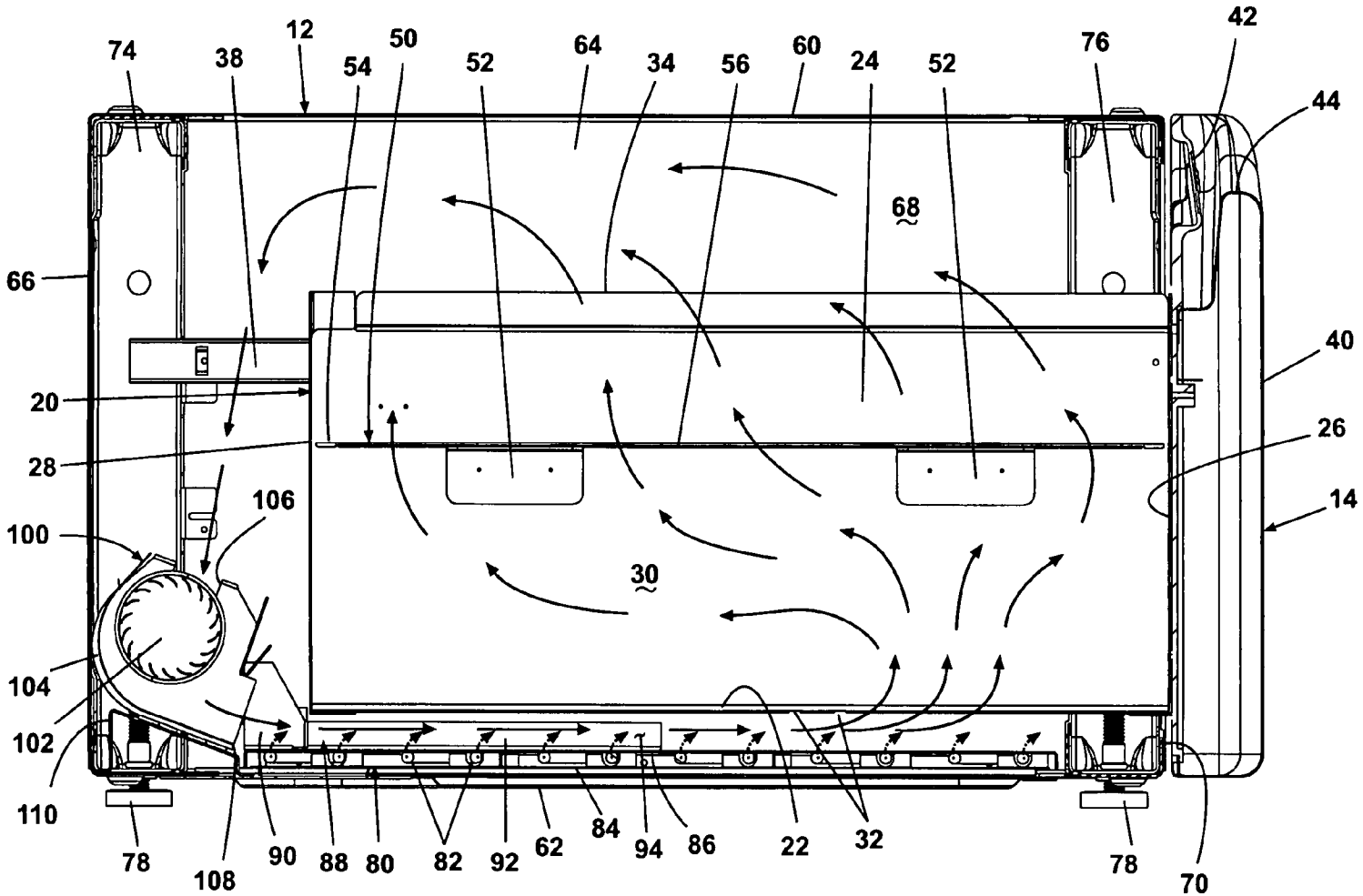
FIG. 7 is a sectional view taken along line 7-7 of FIG. 1.

To operate the non-tumble dryer 10, a user grasps the handle 44 on the drawer front 40 and slides the drawer 14 from the closed position of FIG. 1 to the opened position of FIG. 2. When the drawer 14 is in the opened position, the user can access the drying chamber 30 and can position items to be dried in the drying chamber 30, such as by setting the items on the drawer bottom wall 22 or on the one or more drying racks 50. If desired, the user can adjust the positions of the drying racks 50 relative to the bottom wall 22 and, when the drawer 14 contains more than one of the drying racks 50, relative to each other. After the items to be dried are positioned in the drying chamber 30, the user slides the drawer 14 into the cabinet 12 through the opening 70 to the closed position of FIG. 1. When the drawer 14 is in the closed position, the drying chamber 30 is fully received in the interior 68 of the cabinet 12, and the drawer front 40 closes the opening 70 and thereby the cabinet interior 68, as illustrated in FIG. 7. The user selects the desired drying cycle through the control panel 42, which communicates the selected drying cycle to the controller 120.

The controller 120 controls the operation of the heating element 82 and the blower motor 112 via the relay 122 to execute the selected drying cycle. As shown by solid line arrows in FIG. 7, when the blower motor 112 operates, the blower 102 rotates to draw air in though the air inlet 106 and exhaust air through the air outlet 108 into the air channel 94 formed by the air guides 88 on the heat transfer plate 86. The air flows forward through the air channel 94 and across the heat transfer plate 86, which conducts the heat from the heating element 82 to the air to heat the air, as indicated by dashed line arrows in FIG. 7. The heated air then turns upward and flows through the inlet apertures 32 in the drawer bottom wall 22 to enter the drying chamber 30. The heated air flows upward through the drying chamber 30 from the inlet apertures 32 to the outlet 34 and thereby dries the items to be dried in the drying chamber 30. If the drying rack 50 is in the drying chamber 30, the heated air flows through the drying rack 50 as it flows from the inlet apertures 32 to the outlet 34. After the air exits the drying chamber 30 through the outlet 34, the air is drawn rearward and into the blower 102 through the air inlet 106 to re-circulate the air in the manner just described. Thus, the non-tumble dryer 10 forms a closed air circulation path for drying the items held within the drying chamber 30.

When the selected drying cycle is complete, the user grasps the handle 44 on the drawer front 40 and slides the drawer 14 from the closed position of FIGS. 1 and 7 to the opened position of FIG. 2 to unload the items to be dried from the drawer 14. The user can leave the drying rack(s) 50 supported by the rack supports 52 when not in use, or the drying rack(s) 50 can be stored elsewhere. For example, the drying rack(s) 50 can be set on the bottom wall 22 of the drawer 14 or removed from the drawer 14 and placed in a separate location, such as between the conventional washing machine and dryer. Alternatively, the non-tumble dryer 10 can be adapted to store the drying rack(s) 50 in a recess or cavity, such as a cavity formed in the cabinet 12 above or below the drawer 14.

Figure 8:
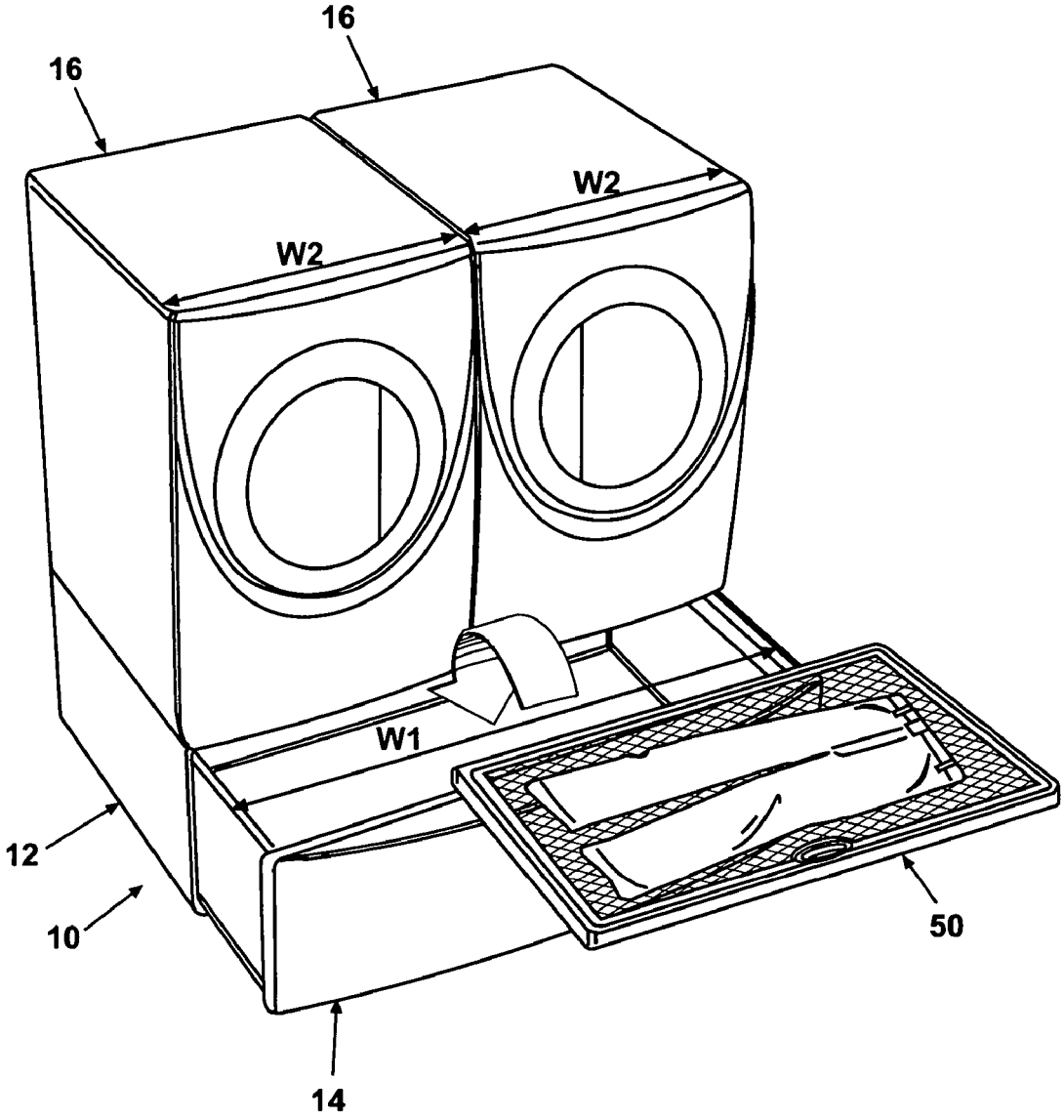
FIG. 8 is a perspective view of the non-tumble dryer of FIG. 1 utilized as a pedestal for a pair of horizontally arranged laundry appliances, wherein a drying rack of the non-tumble dryer is sized according to the width of the drawer.
Figure 9:
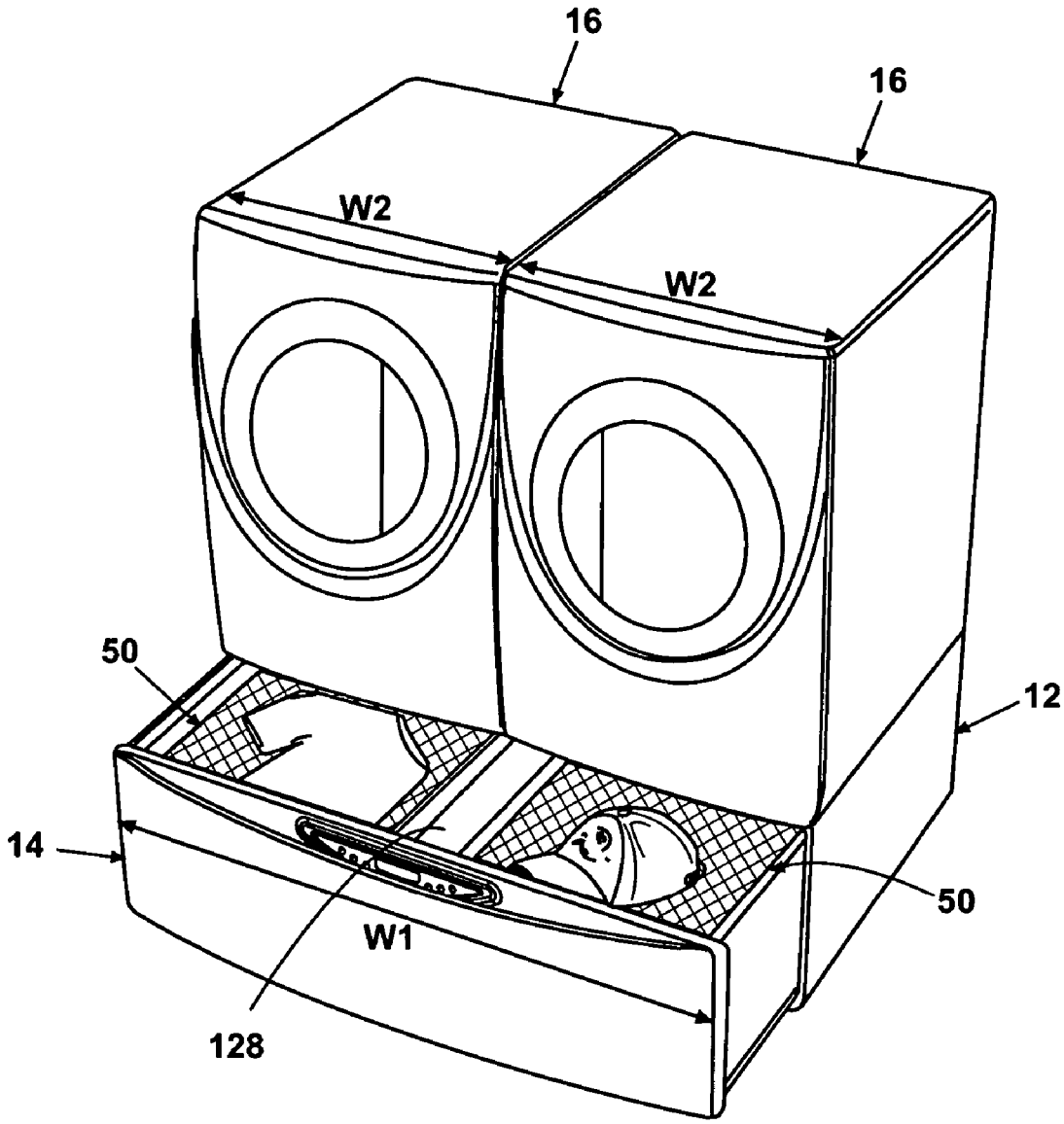
FIG. 9 is a perspective view of the non-tumble dryer of FIG. 1 utilized as a pedestal for a pair of horizontally arranged laundry appliances, wherein two drying racks of the non-tumble dryer are separated by a spacer.

The non-tumble dryer 10 has been described above and shown in the figures as configured to function as a pedestal for the laundry appliance 16 and as having the width W1 about equal to the width W2 of the laundry appliance 16. However, it is within the scope of the invention for the non-tumble dryer 10 to function as a pedestal for more than one laundry appliance 16 or for the width W1 to be greater than the width W2. For example, the non-tumble dryer 10 can function as a pedestal for two of the laundry appliances 16 in a horizontal arrangement, as shown in FIGS. 8 and 9. In these examples, the width W1 is about equal to the sum of the widths W2 of the laundry appliances 16. In the example of FIG. 8, the drying rack 50 is sized to accommodate the width of the drawer 14, while the drying racks 50 in the example of FIG. 9 are sized similarly to the drying rack 50 shown in FIGS. 2 and 3 but are separated by a spacer 128. As stated previously, the non-tumble dryer 10 can be positioned above the laundry appliances 16 or in another suitable location.

Figure 10:
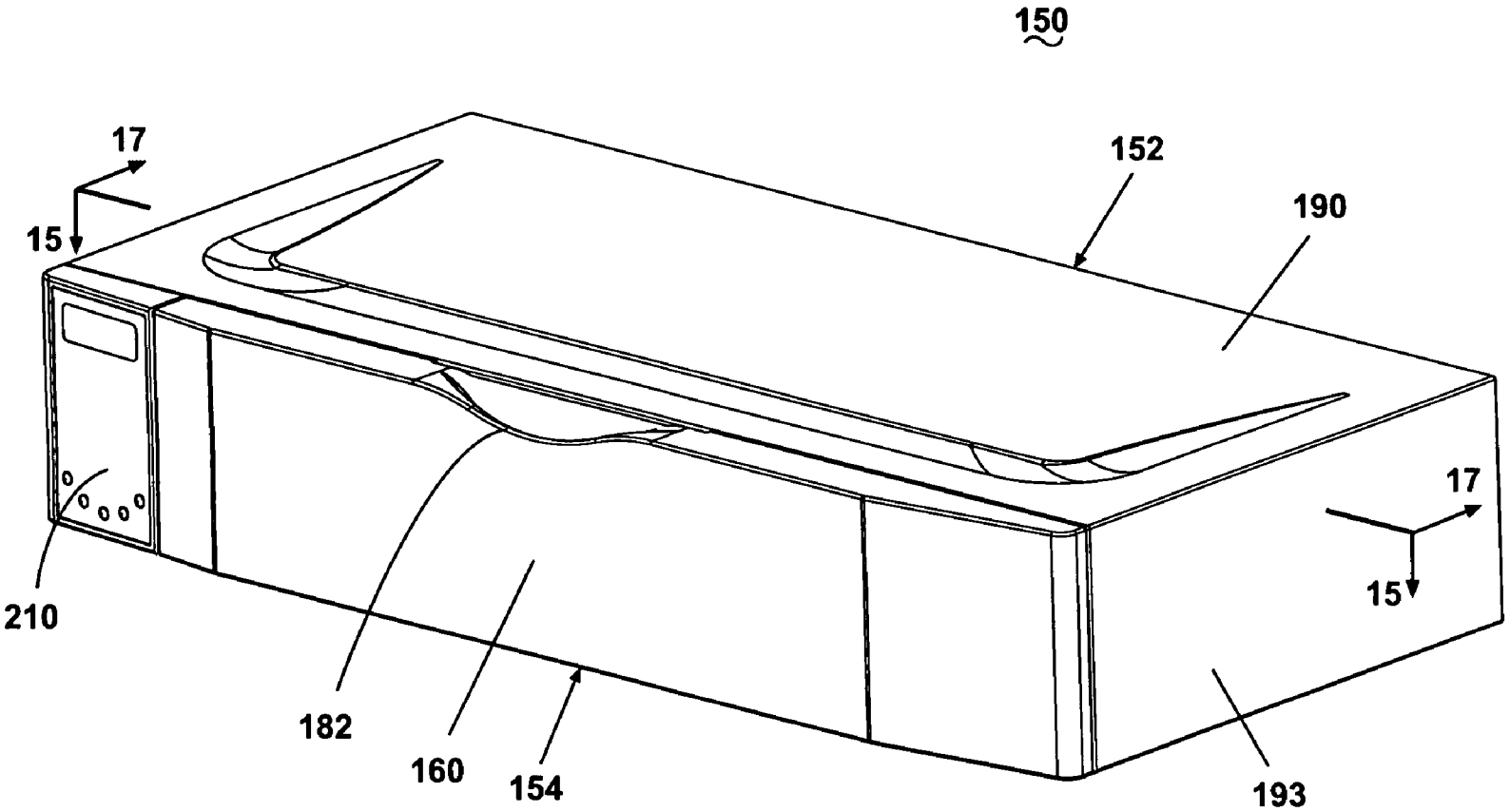
FIG. 10 is a perspective view of a non-tumble dryer according to another embodiment of the invention comprising a drawer slidably mounted to a cabinet and shown in a closed position.
Figure 11:
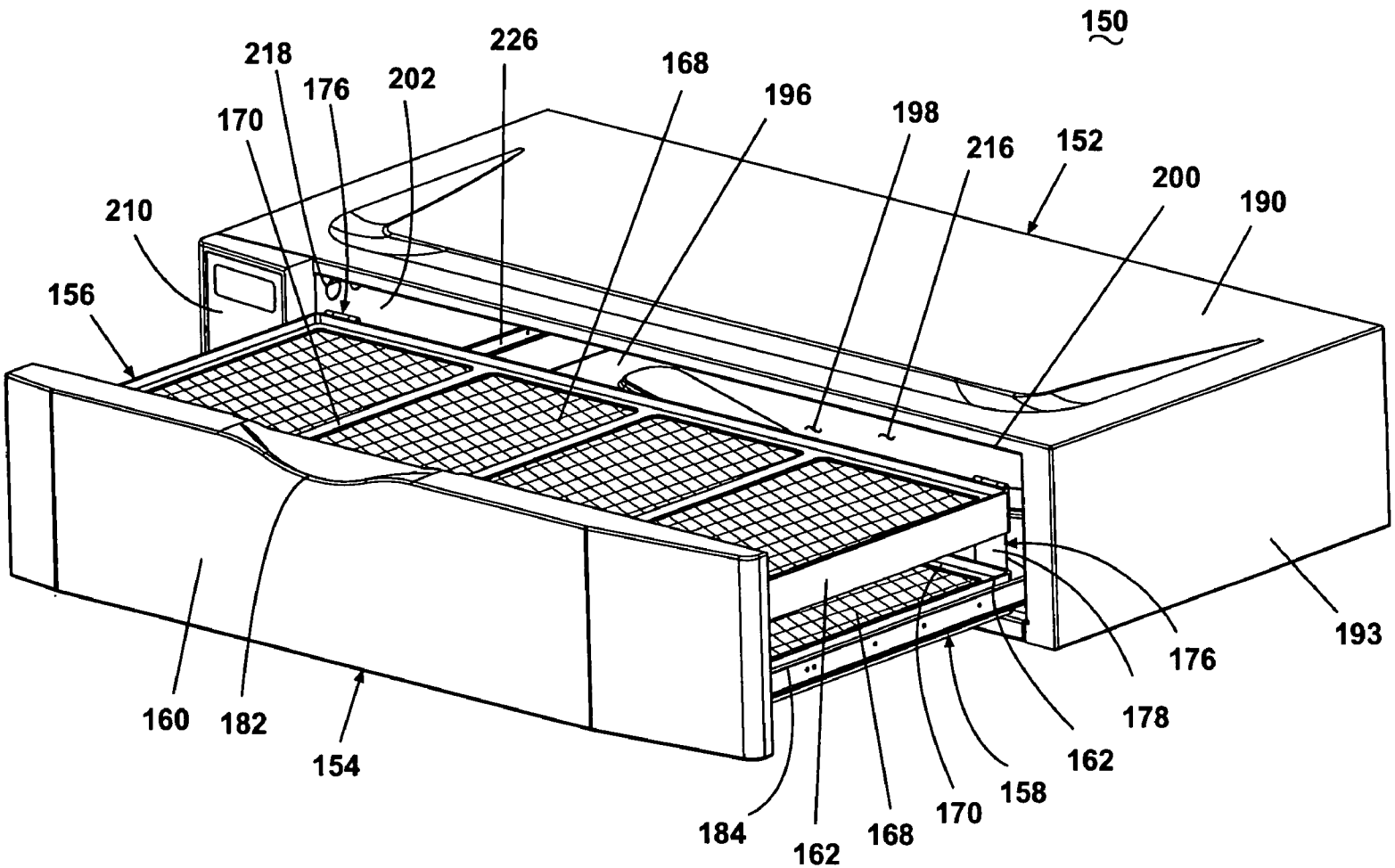
FIG. 11 is a perspective view of the non-tumble dryer of FIG. 10 with the drawer shown in an opened position.
Figure 12:
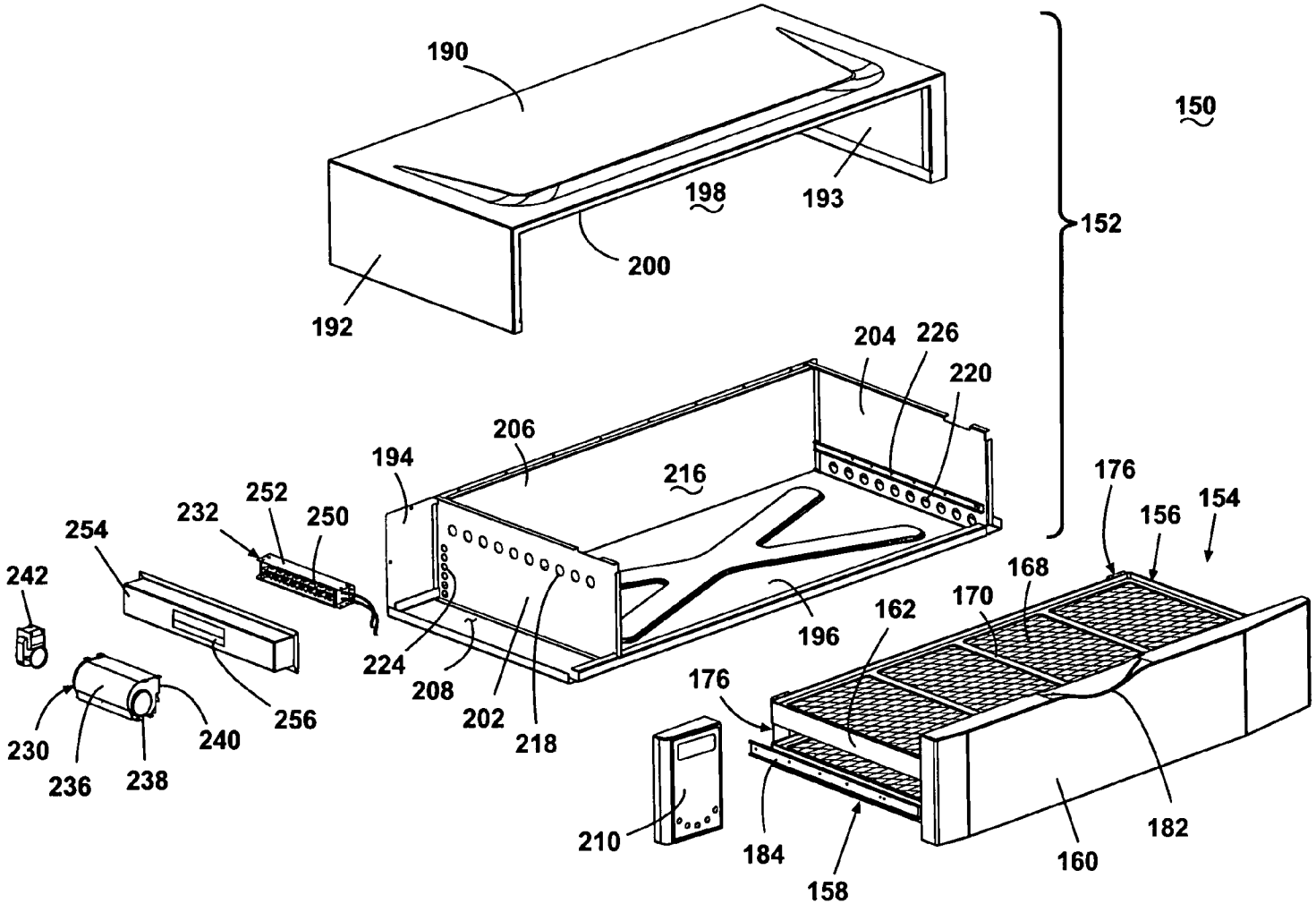
FIG. 12 is an exploded view of the non-tumble dryer of FIG. 10.

FIGS. 10-17 illustrate a non-tumble dryer 150 according to another embodiment of the invention comprising a cabinet 152 and a drawer 154 slidably mounted to the cabinet 152 between a closed position, as shown in FIG. 10, and an opened position, as depicted in FIG. 12. When the drawer 154 is in the opened position, a user can load fabric items, such as clothes, shoes, hats, linens, and the like, onto the drawer 154 so that when the drawer 154 is moved to the closed position, the fabric items can be dried in the non-tumble dryer 150.

Figure 13:
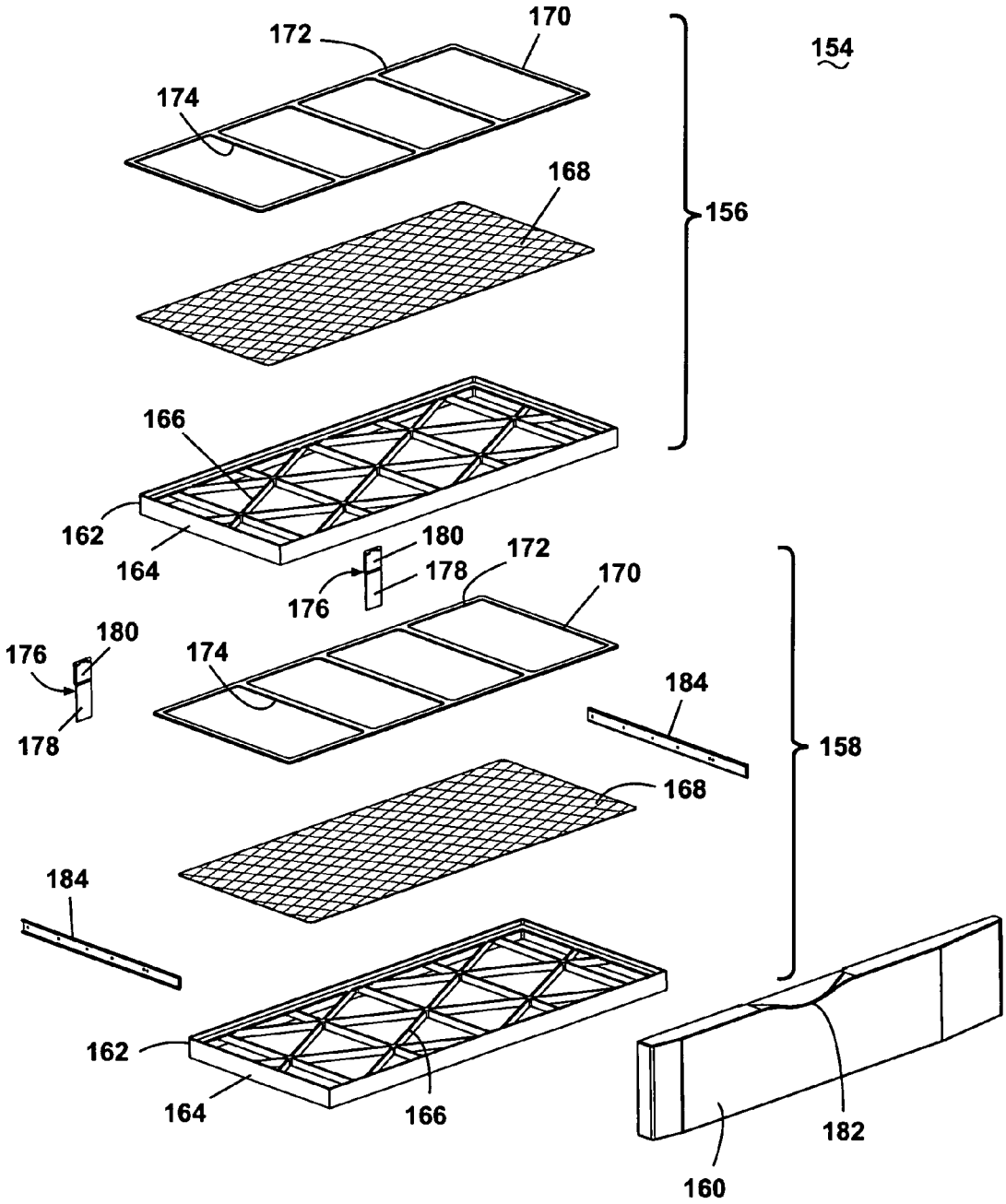
FIG. 13 is an exploded view of the drawer of FIG. 10.
Figure 14:
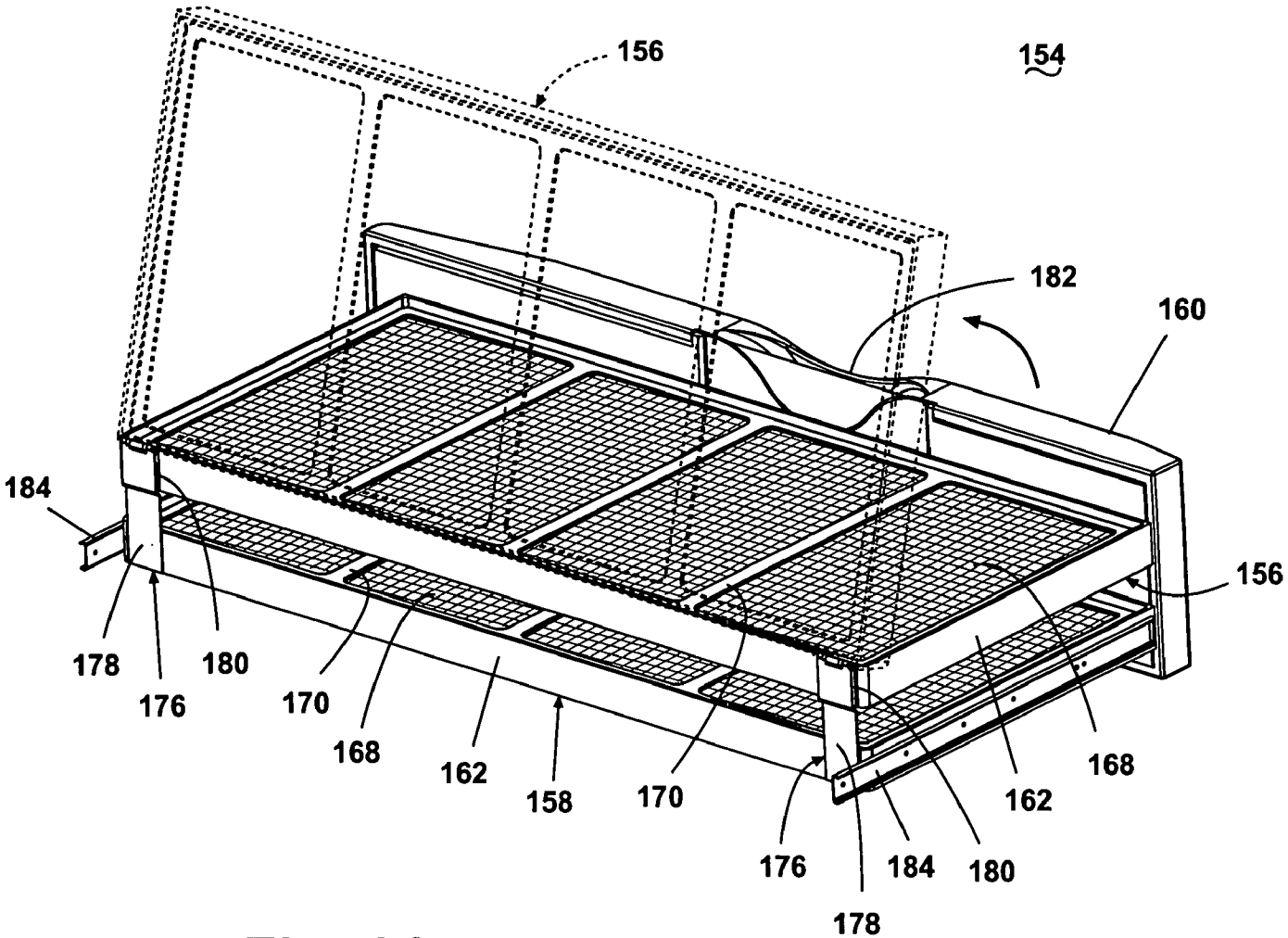
FIG. 14 is a rear perspective view of the drawer of FIG. 10 and showing an upper drying rack of the drawer in a generally horizontal position in solid lines and in a pivoted position in phantom.

Referring now to FIG. 12, the drawer 154 comprises an upper drying rack 156 mounted to a lower drying rack 158, which is mounted to a drawer front 160. As shown in FIG. 13, each of the upper and lower drying racks 156 comprises a lower support 162 having a generally rectangular frame 164 that surrounds a plurality of interconnected ribs 166. The frame 164 is sized to receive an air-permeable panel 168, such as a mesh panel, and an upper support 170 comprising a frame 172 and plurality of horizontal ribs 174. Thus, the air-permeable panel 168 is sandwiched between the lower and upper supports 162, 170. The upper and lower drying racks 156, 158 are connected to one another at their rear ends by a pair of drying rack couplers 176. Each drying rack coupler 176 comprises a generally rectangular body 178 mounted to and extending upward from the lower drying rack 158, as best viewed in FIG. 14. The upper end of the body 178 is hingedly mounted to a bracket 180 mounted to the upper drying rack 156. The bracket 180 can pivot relative to the body 178 so that the upper drying rack 156 can pivot relative to the lower drying rack 158. The upper drying rack 156 is movable between a generally horizontal position shown in solid lines in FIG. 14 and a pivoted position shown in phantom in FIG. 14 so that the lower drying rack 158 can be accessed to position items to be dried on the lower drying rack 158. In FIG. 14, the air-permeable panel 168 of the upper drying rack 156 is not shown in phantom in the pivoted position for visible clarity of the figure. The drawer front 160 can include detents (not shown) on its rear side to support the upper drying rack 156 in the horizontal position. As in the previous embodiment, the drawer front 160 includes a handle 182 graspable by a user for moving the drawer 154 between the closed and opened positions. The drawer 154 further comprises a conventional slide 184 mounted to each side of the lower drying rack 158 for slidably mounting the drawer 154 to the cabinet 152.

Referring back to FIG. 12, the cabinet 152 comprises a top wall 190 integrally formed with depending left and right side walls 192, 193, and the rear edges of the top wall 190 and the side walls 192, 193 are joined by a rear wall 194, while the lower edges of the side walls 192, 193 and the rear wall 194 are joined by a bottom wall 196 substantially parallel with the top wall 190. Together, the cabinet walls 190, 192, 194, 196 define an interior 198 of the cabinet 152 accessible through an opening 200 formed by the front edges of the top, side, and bottom walls 190, 192, 193, 196.

Figure 15:
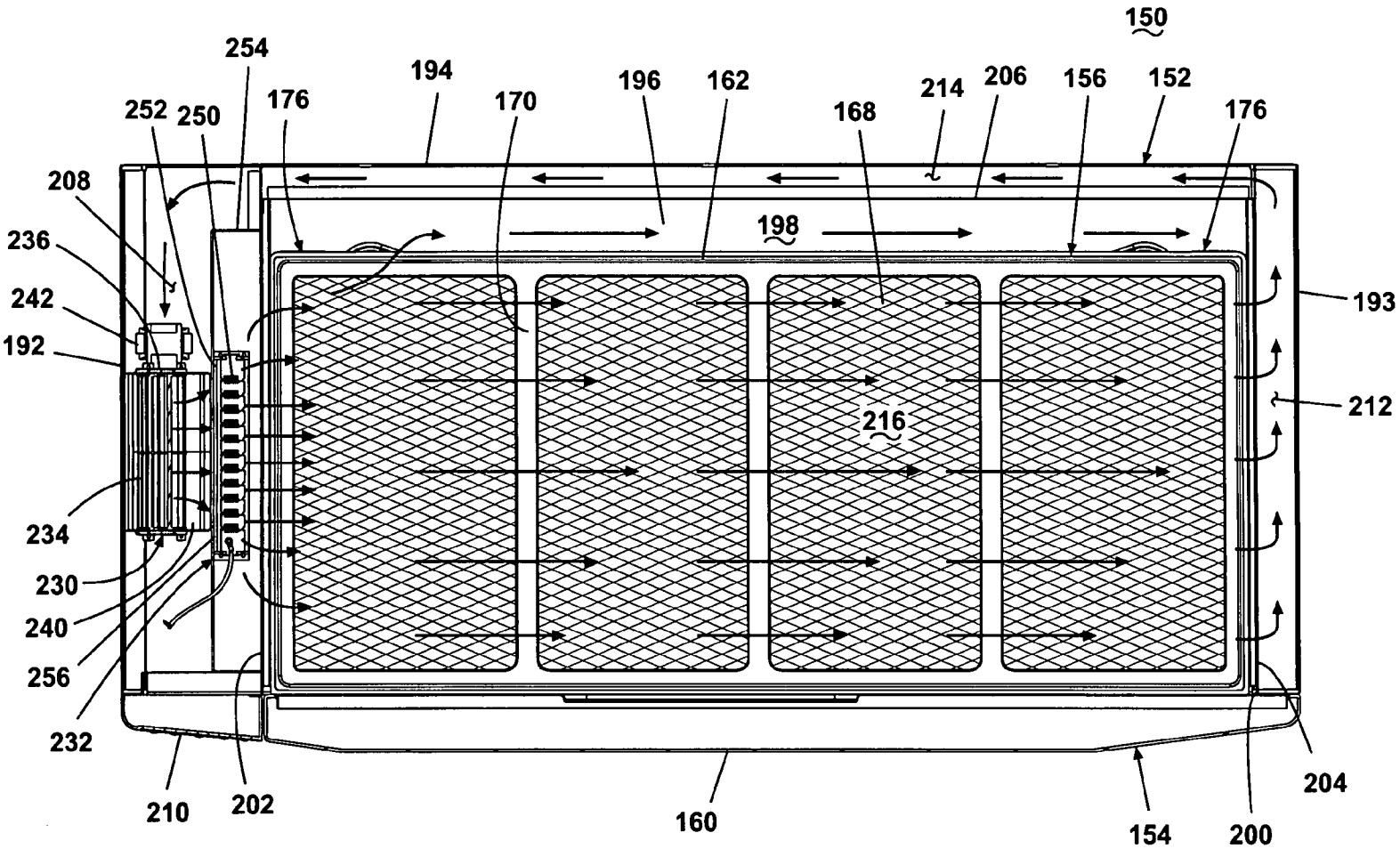
FIG. 15 is a sectional view taken along line 15-15 of FIG. 10.

The cabinet 152 further comprises a set of drying chamber walls comprising a drying chamber left side wall 202, a drying chamber right side wall 204, and a drying chamber rear wall 206. The drying chamber walls 202, 204, 206 extend vertically between the cabinet top and bottom walls 190, 196 such that air cannot pass above or below the drying chamber walls 202, 204, 206. Referring additionally to FIG. 15, the drying chamber left side wall 202 is parallel to and spaced from the cabinet left side wall 192 to form an inlet chamber 208 therebetween. The inlet chamber 208 is closed at the opening 200 by a control panel 210 mounted to the cabinet 12. Similarly, the drying chamber right side wall 204 is parallel to and spaced from the cabinet right side wall 193 to form an outlet chamber 212 therebetween. The drying chamber rear wall 206 is parallel to and spaced from the cabinet rear wall 194 to form a circulation duct 214 therebetween. The circulation duct 214 is closed at its left and right sides by the drying chamber left and right side walls 202, 204, respectively. Together, the drying chamber walls 202, 204, 206 and the cabinet top and bottom walls 190, 196 form a drying chamber 216 accessible through the opening 200.

Figure 16:
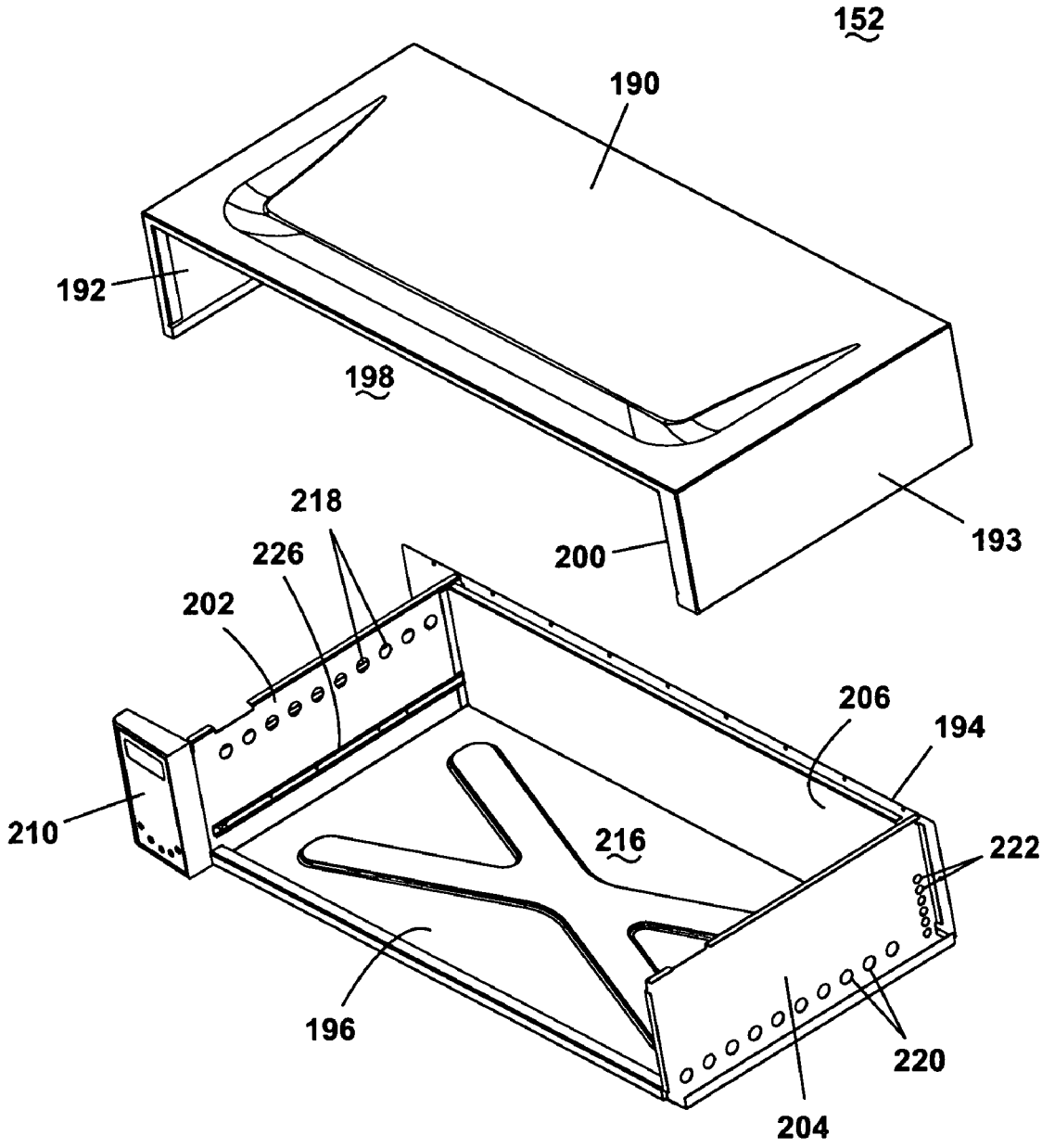
FIG. 16 is an exploded perspective view of the cabinet of the non-tumble dryer of FIG. 10.

Referring back to FIG. 12 and additionally to FIG. 16, an inlet to the drying chamber 216 is defined by a plurality of drying chamber inlet apertures 218 formed in a horizontal row near an upper end of the drying chamber left side wall 202. The drying chamber inlet apertures 218 fluidly couple the inlet chamber 208 with the drying chamber 216. Similarly, an outlet from the drying chamber 216 is defined by a plurality of drying chamber outlet apertures 220 formed in a horizontal row near a lower end of the drying chamber right side wall 204. The drying chamber outlet apertures 220 fluidly couple the drying chamber 218 with the outlet chamber 212. Furthermore, both the drying chamber left and right side walls 202, 204 have a plurality of apertures arranged in a vertical row near a rear end of the respective drying chamber side wall 202, 204 and function as an inlet and as an outlet for the circulation duct 214. The apertures in the drying chamber right side wall 204 function as circulation duct inlets 222 that fluidly couple the outlet chamber 212 with the circulation duct 214. Similarly, the apertures in the drying chamber left side wall 202 function as circulation duct outlets 224 that fluidly couple the circulation duct 214 with the inlet chamber 208.

A track 226 is mounted to an interior surface of each of the drying chamber side walls 202, 204. The tracks 226 mate with the slides 184 on the drawer 154 in a conventional fashion to slidably mount the drawer 154 to the cabinet 152. The drawer 154 slides into and out of the drying chamber 216 through the opening 200. The drying chamber 216 is sized to receive the upper and lower drying racks 156, 158 when the drawer 154 is slid into the closed position through the opening 200.

Figure 17:
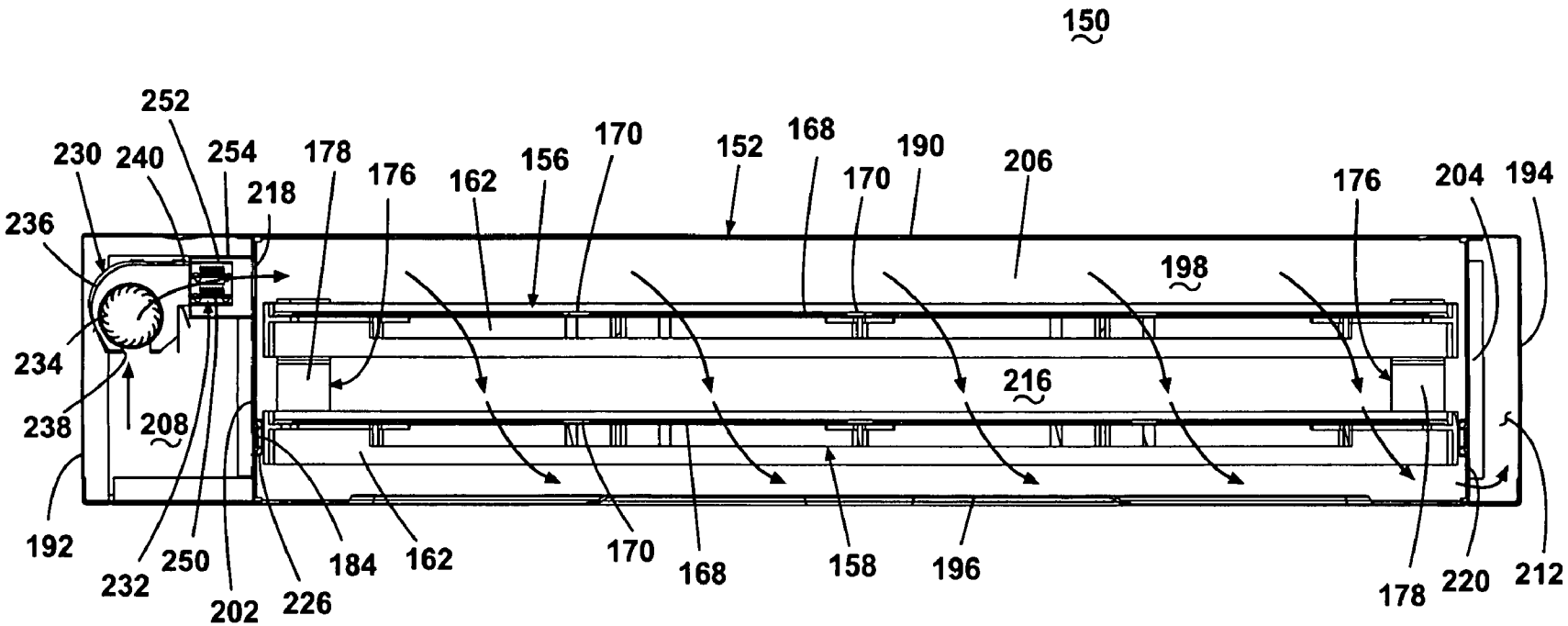
FIG. 17 is a sectional view taken along line 17-17 of FIG. 10.

Referring to FIGS. 12 and 17, the cabinet 152 houses an air supply system 230 and a heating system 232 located in the inlet chamber 208 and operatively coupled to a controller (not shown). The air supply system 230 comprises a blower 234 disposed in a housing 236 defining an air inlet 238 and an air outlet 240 for the blower 234. The air inlet 238 extends across a lower portion of the housing 236 to expose a portion of the blower 234, and the air outlet 240 is a generally rectangular opening extending along a portion of the housing 236 that faces the drying chamber inlet apertures 218. The blower 234 is driven by a blower motor 242 mounted to the housing 236.

The heating system 232 comprises a heating element 250 that can be any suitable source of heat, such as a gas or electric heating element, and is shown in the illustrated embodiment as an electrical heating element supported by a conductive body 252. The conductive body 252 and the heating element 250 are disposed adjacent to the blower air outlet 240 and within an open face duct 254 having an opening 256 sized to receive the blower air outlet 240. The duct 254 is mounted to the drying chamber left side wall 202 such that the drying chamber left side wall 202 closes the open face of the duct 254. The duct 254 is sized to cover the drying chamber inlet apertures 218 so that air that flows from the blower air outlet 240 into the duct 254 is heated by the heating element 250 and leaves the duct 254 by flowing into the drying chamber 216 through the drying chamber inlet apertures 218.

Figure 18:
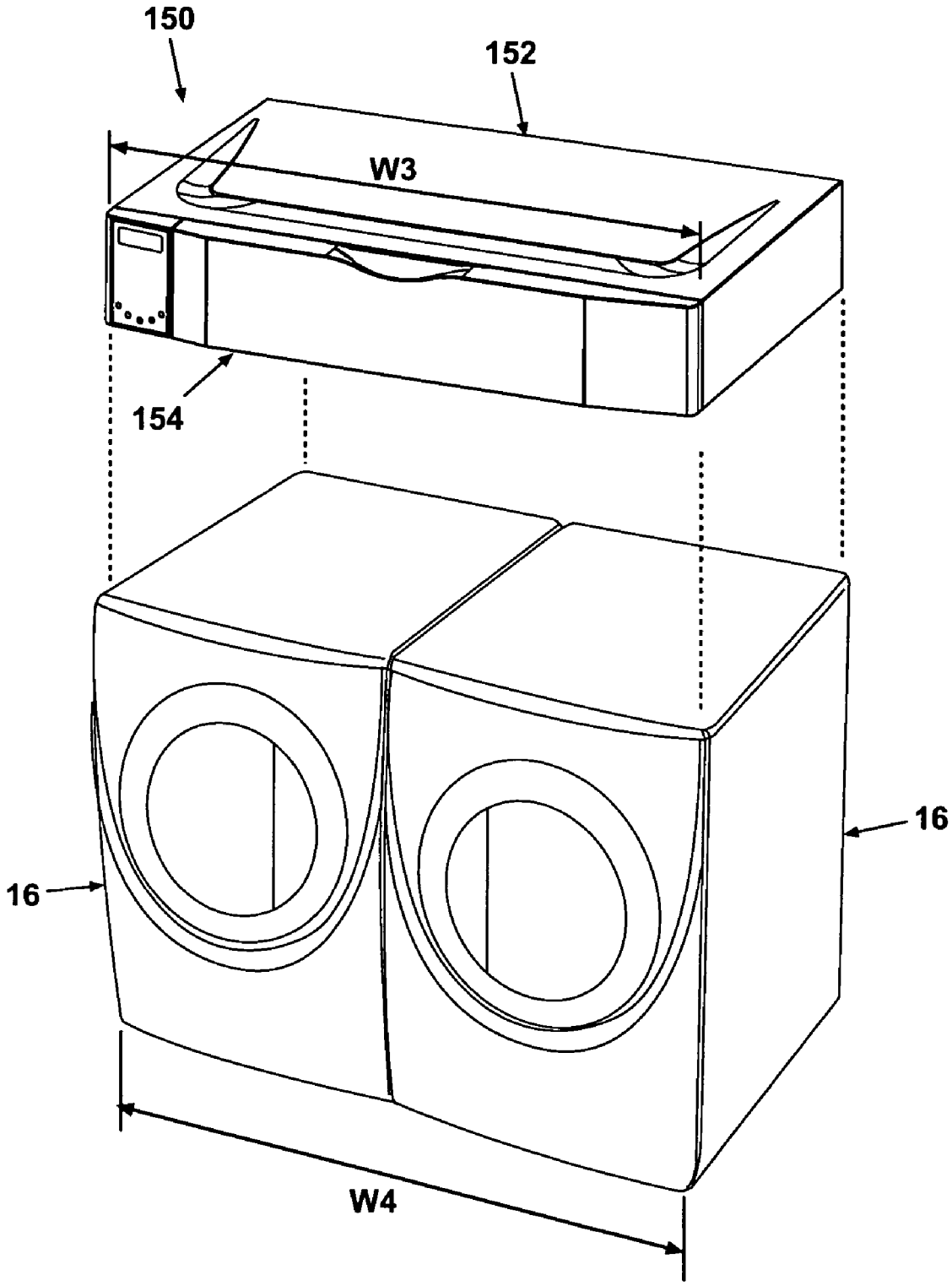
FIG. 18 is a perspective view of the non-tumble dryer of FIG. 10 overlying a pair of horizontally arranged laundry appliances.

Referring now to FIG. 18, the cabinet 152 is sized to overlie a pair of the laundry appliances 10 arranged in a horizontal side-by-side configuration. In the illustrated embodiment, the cabinet 152 has a width W3 substantially equal to a combined width W4 of the laundry appliances 16. As a result, the cabinet 152 completely overlies the pair of the laundry appliances 16 with the sides of the non-tumble dryer 150 and the laundry appliances 16 forming substantially continuous surfaces. The cabinet 152 can also be sized to partially overlie the laundry appliances 16 (i.e., the width W3 is less than the width W4) or to more than completely overlie the laundry appliances 16 (i.e., the width W3 is greater than the width W4). For example, the cabinet 152 can be sized to completely overlie only one of the laundry appliances 16. Furthermore, because the non-tumble dryer 150 is a stand-alone unit that does not rely upon the laundry appliances 16 for a source of air and/or heat, the non-tumble dryer 150 can be positioned in a location other than above the laundry appliances 16. For example, the non-tumble dryer 150 can function as a pedestal and support the laundry appliance(s) 16 in an elevated position. When the non-tumble dryer 150 is used as a pedestal, the cabinet top wall 190 is configured to support the laundry appliance(s) 150 in an elevated position as described above with respect to the non-tumble dryer 10. Further, the non-tumble dryer 150 can be positioned adjacent to the laundry appliance(s) 16, located in another position relative to the laundry appliance(s) 16, or used in any location without the laundry appliance(s) 16.

An exemplary description of the assembly of the non-tumble dryer 150 follows. The following description is provided for illustrative purposes only and is not intended to limit the invention in any manner. The assembly process can proceed in any suitable chronology and is not limited to the sequence explained below.

To assemble the non-tumble dryer 150, the drawer 154 is assembled separately from the cabinet 152. The drawer 154 is assembled by assembling the upper and lower drying racks 156,158 and coupling the upper and lower drying racks 156, 158 via the drying rack couplers 176. The lower drying rack 158 is mounted to the drawer front 160, and the slides 184 are attached to the sides of the lower drying rack 158.

The cabinet 152 is assembled by mounting the drying chamber walls 202, 204, 206 to the cabinet bottom wall 196. The air supply system 230, the heating system 232, and the duct 254 are mounted in the inlet chamber 208, and the tracks 226 are attached to the inside surfaces of the drying chamber side walls 202, 204. The cabinet top wall 190 and side walls 192, 193 are mounted to the cabinet bottom wall 196, and the rear wall 194 is coupled to the cabinet top, side, and bottom walls 190, 192, 193, 196. The control panel 210 is attached to the front of the cabinet 152 to close the inlet chamber 208.

After the drawer 154 and the cabinet 152 are individually assembled, the slides 184 on the drawer 154 are coupled with the tracks 226 on the cabinet 152 to slidably mount the drawer 154 to the cabinet 152.

An exemplary description of the operation of the non-tumble dryer 150 follows. The following description is provided for illustrative purposes only and is not intended to limit the invention in any manner. The operation process can proceed in any suitable chronology and is not limited to the sequence explained below.

To operate the non-tumble dryer 150, a user grasps the handle 182 on the drawer front 160 and slides the drawer 154 from the closed position of FIG. 10 to the opened position of FIG. 11. When the drawer 154 is in the opened position, the user can access the upper and lower drying racks 156, 158 to load items to be dried on the drawer 154. To access the lower drying rack 158, the user pivots the upper drying rack 156 upward to the position shown in phantom in FIG. 14. After the user places the items to be dried on the lower drying rack 158, the user pivots the upper drying rack 156 to the generally horizontal position so that the user can place items to be dried on the upper drying rack 156. After the items to be dried are positioned on the upper and lower drying racks 156, 158, the user slides the drawer 154 into the cabinet 152 through the opening 200 to the closed position of FIG. 12. When the drawer 154 is in the closed position, the drying chamber 216 fully receives the upper and lower drying racks 156, 158, with the upper drying rack 156 located vertically below the drying chamber inlet apertures 218 and the lower drying rack 158 located vertically above the drying chamber outlet apertures 220. Additionally, the drawer front 160 closes the opening 200 and thereby the drying chamber 216, as illustrated in FIG. 15. The user selects the desired drying cycle through the control panel 210, which communicates the selected drying cycle to the controller.

The controller controls the operation of the heating element 250 and the blower motor 242 to execute the selected drying cycle. As shown by arrows in FIGS. 15 and 17, when the blower motor 242 operates, the blower 234 rotates to draw air from the inlet chamber 208 though the blower air inlet 238 and exhaust air through the blower air outlet 240. The exhausted air flows into the duct 254 through the conductive body 252 whereby the heating element 250 heats the air. The duct 254 directs the heated air through the drying chamber inlet apertures 218 into the drying chamber 216. The heated air flows downward through the drying chamber 216 from the drying chamber inlet apertures 218 to the drying chamber outlet apertures 220 and thereby dries the items to be dried in the drying chamber 216. The heated air flows through the upper and lower drying racks 156, 158 as it flows from the drying chamber inlet apertures 218 to the drying chamber outlet apertures 220. The air exits the drying chamber outlet apertures 220 and enters the outlet chamber 212. Air from the outlet chamber 212 enters the circulation duct 214 through the circulation duct inlets 222 and flows through the circulation duct 214 before exiting into the inlet chamber 208 through the circulation duct outlets 224. After the air exits the circulation duct 214, the air is drawn into the blower 234 through the blower air inlet 238 to re-circulate the air in the manner just described. Thus, the non-tumble dryer 150 forms a closed air circulation path for drying the items held within the drying chamber 216.

When the selected drying cycle is complete, the user grasps the handle 182 on the drawer front 160 and slides the drawer 154 from the closed position of FIGS. 10 and 15 to the opened position of FIG. 11 to unload the items to be dried from the drawer 154.

The non-tumble dryer 150 has been described above and shown in the figures as comprising two of the drying racks, the upper drying rack 156 and the lower drying rack 158; however, it is within the scope of the invention for the non-tumble dryer 150 to comprise one of the drying racks or more than two of the drying racks. When the non-tumble dryer 150 comprises more than two of the drying racks, the drying racks positioned above a lowermost drying rack are preferably configured to move, such as by pivoting, so that the user can access the individual drying racks to place items to be dried on the drying racks. Moving the drying racks can also include completely removing the drying racks from the drawer 154. Further, the drawer 154 can comprise a support other than the illustrated drying rack for supporting the items to be dried.

Furthermore, the circulation duct 214 is shown as extending laterally behind the drawer 154, but it is within the scope of the invention for the circulation duct 214 to be located elsewhere in the non-tumble dryer 150. For example, the circulation duct 214 can extend above or below the drawer 154 or in front of the drawer 154.

The non-tumble dryers 10, 150 according to the invention can be modified while remaining within the scope of the invention. For example, the heating systems 80, 232 of the non-tumble dryers 10, 150 can be omitted such that the air supply systems 100, 230 blow non-heated air through the respective drying chambers 30, 216. When the heating system 80, 232 is included, the non-tumble dryers 10, 150 can comprise a temperature sensor to facilitate control of the heating element 82, 250 to control the temperature of the air in the drying chamber 30, 216. Additionally, each of the non-tumble dryers 10, 150 forms a closed air circulation path, but the non-tumble dryers 10, 150 can be modified so that the air that exits the drying chamber 30, 216 exits the cabinet 12, 152 rather than being re-circulated. It also follows that the cabinet 12, 152 can include a fresh air inlet so that the blower 102, 234 takes in fresh air rather than or in addition to re-circulated air. Furthermore, the blower 102, 234 can be configured to draw air through the air circulation paths in a reverse direction rather than the direction described above and shown in the figures by arrows. It is also within the scope of the invention for the drawers 14, 154 to be mounted to the cabinet 12, 152 for types of movement other than sliding movement. For example, the drawers 14, 154 can be pivotally mounted to the cabinet 12, 152. Additionally, the drawers 14, 154 can comprise other supports rather than the drying racks 50, 156, 158 to support items to be dried in the drawers 14, 154. For example, the drawers 14, 154 can comprise a rack specifically adapted to support shoes in a desired position for drying, such as an inclined position. Further, the non-tumble dryers 10, 150 can include an air distributor mechanism to provide jets of air against the rack and to equalize air flow distribution over the rack. An exemplary air distributor mechanism is disclosed in U.S. Pat. No. 6,860,032, which is incorporated herein by reference in its entirety.

The non-tumble dryers 10, 150 have been described as being stacked with the laundry appliance 16. Examples of the laundry appliance 16 include, but are not limited to, a washing machine, a dryer, a combination washing machine and dryer, or a non-aqueous non-aqueous washing apparatus. An exemplary non-aqueous washing apparatus is disclosed in U.S. Patent Application Publication No. 2005/0155393, which is incorporated herein by reference in its entirety. The non-tumble dryers 10, 150 can also be arranged relative to a module of a modular laundry system, such as disclosed in our Ser. No. 11/323,125, filed concurrently herewith, and titled "Modular Laundry System with Horizontal Modules," our Ser. No. 11/322,715, filed concurrently herewith, and titled "Modular Laundry System with Horizontal Module Spanning Two Laundry Appliances," our Ser. No. 11/323,221, filed concurrently herewith, and titled "Modular Laundry System with Horizontally Arranged Cabinet Module," our, Ser. No. 11/322,739, filed concurrently herewith, and titled "Modular Laundry System with Horizontal and Vertical Modules," our Ser. No. 11/323,075, filed concurrently herewith, and titled "Modular Laundry System with Vertical Module," our Ser. No. 11/323,147, filed concurrently herewith, and titled "Modular Laundry System with Cabinet Module," and our Ser. No. 11/322,742, filed concurrently herewith, and titled "Laundry Module for Modular Laundry System," which are incorporated herein by reference in their entirety. Other exemplary modules are disclosed in our Ser. No. 11/323,867, filed concurrently herewith, and titled "Vertical Laundry Module," our Ser. No. 11/322,943, filed concurrently herewith, and titled "Vertical Laundry Module with Backsplash," our Ser. No. 11/323,270, filed concurrently herewith, and titled "Ironing Station," and our Ser. No. 11/322,944, filed concurrently herewith, and titled "Sink Station with Cover," which are incorporated herein by reference in their entirety.

The non-tumble dryers 10, 150 can also be used in conjunction with a work surface, examples of which are disclosed in the above-incorporated modular laundry system applications as well as in our Ser. No. 11/323,220, filed concurrently herewith, and titled "Modular Laundry System with Work Surface," our Ser. No. 11/322,773, filed concurrently herewith, and titled "Modular Laundry System with Segmented Work Surface," our Ser. No. 11/322,741, filed concurrently herewith, and titled "Modular Laundry System with Work Surface Having a Functional Insert," our Ser. No. 11/322,740, filed concurrently herewith, and titled "Modular Laundry System with Work Surface Having a Functional Element," and our Ser. No. 11/323,658, filed concurrently herewith, and titled "Modular Laundry System with Shelf Module," which are incorporated herein by reference in their entirety.

The non-tumble dryers 10, 150 can optionally include a hanging element, such as the retractable hanging elements disclosed in the above-incorporated modular laundry system, laundry module, and work surfaces applications as well as in our Ser. No. 11/322,503, filed concurrently herewith, and titled "Retractable Hanging Element," which is incorporated herein by reference in its entirety.

The non-tumble dryers 10, 150 according to the invention provide several advantages. The non-tumble dryers 10, 150 can optionally be utilized as a pedestal but can function independently of the laundry appliance(s) 16 and, therefore, be positioned in any desirable location relative to the laundry appliance(s) 16, such as on top of the laundry appliance(s) 16. Additionally, when the non-tumble dryer 10, 150 is utilized as a pedestal, the non-tumble dryer 10, 150 can execute a desired drying cycle while a conventional dryer supported by the non-tumble dryer 10, 150 executes a different drying cycle; the non-tumble dryers 10, 150 and the conventional dryer are not required to execute the same drying cycle when operated at the same time. The non-tumble dryer 10, 150 can be relatively wide so that clothing items that are relatively long, such as pants, can be completely laid flat on the drying rack 50, 156, 158 to dry.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry drying pedestal supporting a laundry appliance in an elevated position and for drying a laundry article, the drying pedestal comprising:

a cabinet supporting a laundry appliance thereupon, the cabinet having a width and a height, which is less than the width, and defining an open face providing access to an interior of the cabinet;

a drawer supporting a laundry article to be dried, the drawer being slidably mounted to the cabinet for movement between an opened and closed position, and having a drawer front closing the open face when the drawer is in the closed position;

a non-tumble drying chamber defined at least partially by the drawer;

an air supply blower contained entirely within the cabinet to provide air to the non-tumble drying chamber to dry the laundry article supported by the drawer; and a heating blower contained entirely within the cabinet and coupled to the air supply blower to heat the air supplied by the air supply system;

wherein the drying pedestal supports the laundry appliance while being separable from and independently operated from the laundry appliance; and wherein the air is circulated entirely within the non-tumble drying chamber independently of the laundry appliance to dry tile laundry article supported by, the drawer.

2. The laundry drying pedestal according to claim 1, wherein the drawer comprises a drying rack for supporting an article to be dried in a generally horizontal position.

3. The laundry drying pedestal according to claim 2, wherein the drying rack comprises an air-permeable panel that at least partially supports an article to be dried and permits air from the air supply blower to flow through the drying rack.

4. The laundry drying pedestal according to claim 2, wherein the cabinet forms the non-tumble drying chamber, and the drying rack is movable with the drawer relative to the non-tumble drying chamber.

5. The laundry drying pedestal according to claim 2, wherein the drying chamber has an air inlet and an air outlet, where one of the air inlet and the air outlet is located above the drying rack, and the other of the air inlet and the air outlet is located below the drying rack.

6. The laundry drying pedestal according to claim 5, and further comprising an air duct fluidly coupling the air outlet to the air inlet.

7. The laundry drying pedestal according to claim 6, wherein the air duct extends laterally behind the drawer.

8. The laundry drying pedestal according to claim 6, wherein the heating element is fluidly coupled to the air duct to heat the air passing through the air duct.

9. The laundry drying pedestal according to claim 1, wherein the air supply blower provides air beneath the drawer when the drawer is received in the interior of the cabinet.

10. The laundry drying pedestal according to claim 9, wherein the drawer comprises a bottom wall having a plurality of apertures, and the air provided beneath the drawer enters the drawer through the apertures.

11. The laundry drying pedestal according to claim 10, wherein the drawer further comprises a peripheral wall extending upward from the bottom wall to define the non-tumble drying chamber.

12. The laundry drying pedestal according to claim 10, wherein the heating element is mounted in the cabinet below the drawer to heat the air provided beneath the drawer before entering the drawer through the apertures.

13. The laundry drying pedestal according to claim 1, wherein the air supply blower has an outlet that provides the air through the non-tumble drying chamber and an inlet that receives the air exhausted from the non- tumble drying chamber.

14. The laundry drying pedestal according to claim 1, wherein the top of the cabinet has a width approximately equal to that of a laundry appliance.

15. The laundry drying pedestal according to claim 1, wherein the drying chamber has an air inlet and an air outlet, where one of the air inlet and the air outlet is located above the drawer, and the other of the air inlet and the air outlet is located below the drawer.

16. The laundry drying pedestal according to claim 15, and further comprising an air duct fluidly coupling the air outlet to the air inlet.

17. The laundry drying pedestal according to claim 16, wherein the air duct extends laterally behind the drawer.

18. The laundry drying pedestal according to claim 16, wherein the heating element is fluidly coupled to the air duct to heat the air passing through the air duct.

19. A laundry drying pedestal supporting a laundry appliance in an elevated position and for drying a laundry article, the drying pedestal consisting essentially of:

a cabinet supporting a laundry appliance thereupon, the cabinet having a width and a height, which is less than the width, and defining an open face providing access to an interior of the cabinet;

a drawer supporting a laundry article to be dried, the drawer being slidably mounted to the cabinet for movement between an opened and closed position, and having a drawer front closing the open face when the drawer is in the closed position;

a non-tumble drying chamber defined at least partially by the drawer;

an air supply blower contained within the cabinet to provide air to the non-tumble drying chamber to dry the laundry article supported by the drawer; and a heating element contained within the cabinet and coupled to the air supply blower to heat the air supplied by the air supply system;

wherein the drying pedestal supports the laundry appliance while being separable from and independently operated from the laundry appliance; and wherein the air is circulated within the non-tumble drying chamber independently of the laundry appliance to dry the laundry article supported by the drawer.

20. The laundry drying pedestal according to claim 19, wherein the drawer comprises a drying rack for supporting an article to be dried in a generally horizontal position.

21. The laundry drying pedestal according to claim 20, wherein the drying rack comprises an air-permeable panel that at least partially supports an article to be dried and permits air from the air supply blower to flow through the drying rack.

22. The laundry drying pedestal according to claim 20, wherein the cabinet forms the non-tumble drying chamber, and the drying rack is movable with the drawer relative to the non-tumble drying chamber.

23. The laundry drying pedestal according to claim 20, wherein the drying chamber has an air inlet and an air outlet, where one of the air inlet and the air outlet is located above the drying rack, and the other of the air inlet and the air outlet is located below the drying rack.

24. The laundry drying pedestal according to claim 23, and further comprising an air duct fluidly coupling the air outlet to the air inlet.

25. The laundry drying pedestal according to claim 24, wherein the air duct extends laterally behind the drawer.

26. The laundry drying pedestal according to claim 24, wherein the heating element is fluidly coupled to the air duct to heat the air passing through the air duct.

27. The laundry drying pedestal according to claim 19, wherein the air supply system blower provides air beneath the drawer when the drawer is received in the interior of the cabinet.

28. The laundry drying pedestal according to claim 27, wherein the drawer comprises a bottom wall having a plurality of apertures, and the air provided beneath the drawer enters the drawer through the apertures.

29. The laundry drying pedestal according to claim 28, wherein the drawer further comprises a peripheral wall extending upward from the bottom wall to define the non-tumble drying chamber.

30. The laundry drying pedestal according to claim 28, wherein the heating element is mounted in the cabinet below the drawer to heat the air provided beneath the drawer before entering the drawer through the apertures.

31. The laundry drying pedestal according to claim 19, wherein the air supply blower has an outlet that provides the air through the non-tumble drying chamber and an inlet that receives the air exhausted from the non- tumble drying chamber.

32. The laundry drying pedestal according to claim 19, wherein the top of the cabinet has a width approximately equal to that of a laundry appliance.

33. The laundry drying pedestal according to claim 19, wherein the drying chamber has an air inlet and an air outlet, where one of the air inlet and the air outlet is located above the drawer, and the other of the air inlet and the air outlet is located below the drawer.

34. The laundry drying pedestal according to claim 33, and further comprising an air duct fluidly coupling the air outlet to the air inlet.

35. The laundry drying pedestal according to claim 34, wherein the air duct extends laterally behind the drawer.

36. The laundry drying pedestal according to claim 34, wherein the heating element is fluidly coupled to the air duct to heat the air passing through the air duct.

* * * * *